US011015590B2

(12) United States Patent
Howell, Sr.

(10) Patent No.: US 11,015,590 B2
(45) Date of Patent: May 25, 2021

(54) DOWNHOLE PUMP SYSTEM

(71) Applicant: William R. Howell, Sr., Fort Worth, TX (US)

(72) Inventor: William R. Howell, Sr., Fort Worth, TX (US)

( * ) Notice: Subject to any disclaimer, the term of this patent is extended or adjusted under 35 U.S.C. 154(b) by 430 days.

(21) Appl. No.: 15/893,116

(22) Filed: Feb. 9, 2018

(65) Prior Publication Data

US 2018/0230990 A1 Aug. 16, 2018

Related U.S. Application Data

(60) Provisional application No. 62/457,466, filed on Feb. 10, 2017.

(51) Int. Cl.

| | |
|---|---|
| ***E21B 43/12*** | (2006.01) |
| ***F04B 47/08*** | (2006.01) |
| ***F04B 9/107*** | (2006.01) |
| ***F04B 47/04*** | (2006.01) |

(52) U.S. Cl.

CPC ..... *F04B 47/08* (2013.01); *E21B 43/128* (2013.01); *E21B 43/129* (2013.01); *F04B 9/107* (2013.01); *F04B 47/04* (2013.01)

(58) Field of Classification Search

CPC combination set(s) only.
See application file for complete search history.

(56) References Cited

U.S. PATENT DOCUMENTS

| | | | | |
|---|---|---|---|---|
| 3,982,591 | A * | 9/1976 | Hamrick | E21B 34/16 166/302 |
| 4,383,436 | A * | 5/1983 | Hailey | E21B 33/062 73/46 |
| 4,421,163 | A * | 12/1983 | Tuttle | E21B 36/006 166/59 |
| 5,289,888 | A * | 3/1994 | Talley | E21B 43/32 166/50 |
| 5,520,046 | A * | 5/1996 | Sornein | E21B 49/08 73/152.23 |
| 6,092,599 | A * | 7/2000 | Berry | E21B 43/121 166/106 |
| 8,602,100 | B2 * | 12/2013 | Dykstra | E21B 43/24 166/272.3 |
| 9,382,800 | B2 | 7/2016 | Simpson | |
| 2009/0195117 | A1 * | 8/2009 | Parmeter | H02K 1/185 310/216.129 |
| 2015/0083399 | A1 * | 3/2015 | Fripp | E21B 43/128 166/250.01 |
| 2017/0306731 | A1 * | 10/2017 | Xiao | E21B 43/128 |

FOREIGN PATENT DOCUMENTS

| | | | | |
|---|---|---|---|---|
| EP | 0069828 | A2 * | 1/1983 | E21B 43/24 |

* cited by examiner

*Primary Examiner* — Cathleen R Hutchins
*Assistant Examiner* — Ronald R Runyan
(74) *Attorney, Agent, or Firm* — Sterne, Kessler, Goldstein & Fox P.L.L.C.

(57) ABSTRACT

A downhole pump system for increasing production of a well includes a mechanical steam pump, a steam generator, a plurality of electrical pumps, and a cable. The mechanical steam pump is disposed within a horizontal section of the well. The electrical pumps are disposed in series within the vertical section of the well above the steam generator. The cable connects the mechanical steam pump, the steam generator, and the electrical pumps.

24 Claims, 23 Drawing Sheets

DOWNHOLE PUMP SYSTEM

CROSS-REFERENCE TO RELATED APPLICATION

This application claims priority to U.S. Provisional Application No. 62/457,466, filed Feb. 10, 2017, the disclosure of which is incorporated herein in its entirety by reference thereto.

BACKGROUND

Field

The present disclosure relates to a downhole pump system. More specifically, the present disclosure relates to a well downhole pump system that utilizes a plurality of pumps and a steam generation system to stimulate production from the well.

Background

A well (e.g., an oil well) can decrease in production as fluid and other material(s) build up in the well. The fluid and other material(s) can include, for example, debris, sand, gels, water, gas, and chemicals. The fluid and other material(s) can build up in the horizontal and/or the vertical portion of the wellbore. As a result of this buildup, the well can have low pressure at the wellhead and have lower production despite having substantial amounts of oil within the well reservoir.

Current solutions to this buildup of fluid and other materials and the resulting low production of wells are unsatisfactory. For example, existing technology utilizes pumps that are located deep within the vertical of the wellbore. As a result, a large amount of power is required to lift the fluid and other materials out of the wellbore, which leads to a higher operating expense. Further, production of the well must be interrupted to install these existing pumps. In addition, existing systems are permanently installed and can therefore only be used in a single well. Accordingly, improvements to downhole pump systems are desirable.

BRIEF SUMMARY

The present disclosure details a downhole pump system and apparatuses and methods related to the downhole pump system. A downhole pump system for increasing production of a well can include a mechanical steam pump, a steam generator, a plurality of electrical pumps, a work service rig, and a cable. In some embodiments, the mechanical steam pump is disposed within a horizontal section of the well. In some embodiments, a steam generator has an outer housing, a heating element disposed within the outer housing, and a nozzle disposed within the outer housing. In some embodiments, the steam generator is disposed within a vertical section of the well. In some embodiments, the electrical pumps are disposed in series within the vertical section of the well above the steam generator. In some embodiments, the work service rig is disposed above the well. In some embodiments, the cable connects the mechanical steam pump to the steam generator, the steam generator to a lowest one of the electrical pumps, the electrical pumps to each other in series, and a highest one of the electrical pumps to the work service rig.

In some embodiments, the cable provides power to the plurality of electrical pumps. In some embodiments, the cable provides communication between the plurality of electrical pumps. In some embodiments, the cable provides communication between the work service rig and the plurality of electrical pumps.

In some embodiments, the cable includes a conduit to deliver water from the work service rig to the steam generator and steam from the steam generator to the mechanical steam pump. In some embodiments, the conduit travels through the center of the plurality of electrical pumps. In some embodiments, the conduit travels on an outside of the plurality of electrical pumps (e.g. bypasses the electrical pumps) or through an outer portion of the plurality of electrical pumps. In some embodiments, the cable provides power through the center of the plurality of electrical pumps. In some embodiments, the cable provides power on an outside of the plurality of electrical pumps or through an outer portion of the plurality of electrical pumps. In some embodiments, each of the electrical pumps includes an expandable bladder to provide a seal between an annulus of the vertical and the electrical pump.

In some embodiments, the downhole pump system also includes an installation device disposed on the work service rig. In some embodiments, the installation device attaches to a production tree of the well. In some embodiments, the installation device includes two upper pistons, two lower pistons, a middle chamber disposed between the two upper pistons and the two lower pistons, and a lower chamber disposed below the two upper pistons. In some embodiments, the lower chamber is configured to attach to the production tree. In some embodiments, the two upper pistons are configured to shift between an open position and a closed position. In some embodiments, the open position allows the cable, the plurality of electrical pumps, the steam generator, and/or the mechanical steam pump to pass between the two upper pistons. In some embodiments, the closed position seals the middle chamber from ambient air.

In some embodiments, the two lower pistons are configured to shift between an open position and a closed position. In some embodiments, the open position allows the cable, the plurality of electrical pumps, the steam generator, and the mechanical steam pump to pass between the two lower pistons. In some embodiments, the closed position seals the lower chamber from the middle chamber.

In some embodiments, the downhole pump system is removed from the well and transported to another well. In some embodiments, the plurality of electrical pumps each comprise a stator disposed on an inside of the plurality of electrical pumps. In some embodiments, the mechanical steam pump comprises a fluid inlet and a projection disposed adjacent to the fluid inlet. In some embodiments, the mechanical steam pump is configured to pump fluid over a top of the projection and into the fluid inlet and trap debris below the projection. In some embodiments, the mechanical steam pump includes a gap disposed below the projection to relieve back pressure in the mechanical steam pump. In some embodiments, the steam generator also includes a solenoid valve configured to regulate fluid in the steam generator.

In some embodiments, a method for increasing production of a well includes attaching an installation device to a production tree of the well, passing a mechanical steam pump, a steam generator, and a plurality of electrical pumps into the well through the installation device, determining a location of fluid in the vertical section of the well, pumping fluid out of the vertical section of the well by sequentially powering each of the plurality of electrical pumps to pump fluid up to an adjacent electrical pump, and delivering water to the steam generator through the cable. In some embodiments, the installation device comprises two upper pistons and two lower pistons. In some embodiments, the mechanical steam pump, the steam generator, and the plurality of electrical pumps are connected in series via a cable. In some embodiments, the steam generator converts the water to steam.

In some embodiments, passing the mechanical steam pump, the steam generator, and the plurality of electrical pumps into the well includes opening the two upper pistons, passing the mechanical steam pump between the two upper pistons into a middle chamber, closing the two upper pistons, opening the two lower pistons, and passing the mechanical steam pump between the two lower pistons into a lower chamber. In some embodiments, the lower chamber is in fluid communication with the production tree of the well.

In some embodiments, passing the mechanical steam pump, the steam generator, and the plurality of electrical pumps into the well includes closing the two lower pistons, evacuating the middle chamber with a pump, feeding the cable between the two upper pistons through an upper bladder and the two lower pistons through a lower bladder while the two upper pistons and the two lower pistons are closed, opening the two upper pistons, passing the steam generator between the two upper pistons into a middle chamber, closing the two upper pistons, opening the two lower pistons, passing the steam generator between the two lower pistons into a lower chamber. In some embodiments, the lower chamber is in fluid communication with the production tree of the well.

In some embodiments, passing the mechanical steam pump, the steam generator, and the plurality of electrical pumps into the well includes closing the two lower pistons, evacuating the middle chamber with a pump, feeding the cable between the two upper pistons through an upper bladder and the two lower pistons through a lower bladder while the two upper pistons and the two lower pistons are closed, opening the two upper pistons, passing an electrical pump between the two upper pistons into a middle chamber, closing the two upper pistons, opening the two lower pistons, passing the electrical pump between the two lower pistons into a lower chamber. In some embodiments, the lower chamber is in fluid communication with the production tree of the well In some embodiments, passing the mechanical steam pump, the steam generator, and the plurality of electrical pumps into the well includes closing the two lower pistons, evacuating the middle chamber with a pump, and feeding the cable between the two upper pistons through an upper bladder and the two lower pistons through a lower bladder while the two upper pistons and the two lower pistons are closed.

BRIEF DESCRIPTION OF THE DRAWINGS/FIGURES

The accompanying figures, which are incorporated herein, form part of the specification and illustrate embodiments of downhole pump systems and components thereof. Together with the description, the figures further serve to explain the principles of and allow for the making and using of the embodiments described herein. These figures are intended to be illustrative, not limiting. Although the disclosure is generally described in the context of these embodiments, it should be understood that it is not intended to limit the scope of the disclosure to these particular embodiments. In the drawings, like reference numbers indicate identical or functionally similar elements.

DETAILED DESCRIPTION

Figure 1:
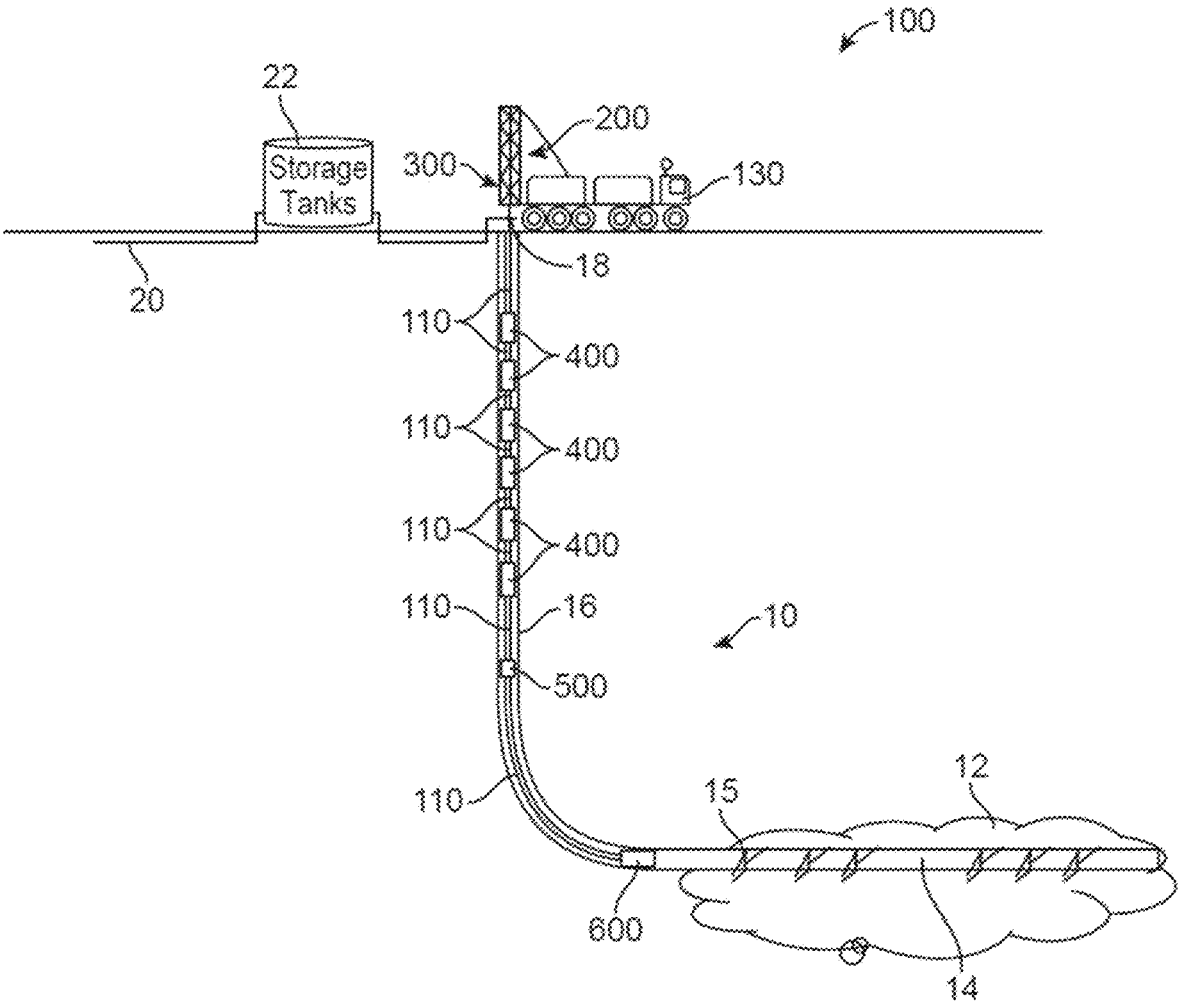
FIG. 1 illustrates a downhole pump system according to some embodiments.

While the disclosure refers to illustrative embodiments, it should be understood that the disclosure is not limited thereto. Modifications can be made to the embodiments described herein without departing from the spirit and scope of the present disclosure. Those skilled in the art with access to this disclosure will recognize additional modifications, applications, and embodiments within the scope of this disclosure and additional fields in which the disclosed examples could be applied. Therefore, the following detailed description is not meant to be limiting.

Further, it is understood that the devices and methods described herein can be implemented in many different embodiments of hardware. Any actual hardware described is not meant to be limiting. The operation and behavior of the devices, systems, and methods presented are described with the understanding that modifications and variations of the embodiments are possible given the level of detail presented.

The downhole pump system disclosed herein can operate to increase production of a low-producing well without interfering with or interrupting the well's current production. The downhole pump system provides an improved artificial lift method to remove fluid(s) from the well's vertical section through deliquification, reducing hydrostatic forces within the column. In some embodiments, the downhole pump system further stimulates the horizontal section of the well with a steam generation system. Thus, the downhole pump system can remove at least a portion of the fluid and other material(s) from the well and also push the product up the well to increase production.

The downhole pump system is portable and therefore can be used to increase production on a number of wells. For example, the entire system can be carried on an auxiliary service rig. The system can include a work service rig, a control center, a service line cable, a power generation unit, a water supply system, an installation device, electrical submersible pumps, and a steam generation system.

For example, the auxiliary service rig can drive to a low-producing well. Upon arriving at the well, the work service rig can be installed at the well head through the installation device. Specifically, the installation device can attach to the production tree disposed on the wellhead. The installation device allows for installation of the downhole pump system without interrupting production of the well.

After the installation device is connected to the production tree, the steam generation system and electrical submersible pumps can be inserted into the wellbore, with the service line cable connecting each component. The electrical submersible pumps are disposed in the vertical annulus of the wellbore and separated by a predetermined distance that corresponds to a predetermined desired lifting capability. Each electrical submersible pump therefore only needs to lift the fluid up to the next electrical submersible pump. Thus, the electrical submersible pumps can sequentially pump the fluid up the vertical annulus until the wellhead pressure increases to a desired amount.

The steam generation system can operate to stimulate the horizontal. Water is sent down the service line cable to a steam generator, where the water is vaporized and sent to a mechanical steam pump. The mechanical steam pump moves debris and other low viscosity fluid away from the entrance to the horizontal and keeps the debris and other low viscosity fluid from blocking the entrance to the horizontal again. The mechanical steam pump also creates a low pressure at the inlet, thus drawing in product (e.g., oil), which is sent up to the electrical submersible pumps. The electrical submersible pumps can then sequentially pump the product to the wellhead. As a result, the production of the well increases. While an oil well is primarily discussed herein, the downhole pump system can also be utilized in other wells.

These and other embodiments are discussed below with reference to the figures. However, those skilled in the art will readily appreciate that the detailed description given herein with respect to these figures is for explanatory purposes only and should not be construed as limiting.

A downhole pump system 100, according to some embodiments, can be installed into a well 10 to improve production, as shown, for example, in FIG. 1. Well 10 includes a reservoir 12 of product, such as oil, a horizontal section 14, and a vertical section 16. Fractures 15 introduce the product into horizontal section 14, which then flows into vertical section 16. Vertical section 16 leads into a production tree 18 (commonly referred to as a "Christmas tree"), which directs and controls the flow of the product from well 10. For example, production tree 18 can direct the product into a storage tank 22 and/or a production line 20. In some embodiments, downhole pump system 100 is a removable and portable system, allowing for installation in multiple wells 10. In some embodiments, downhole pump system 100 may be used to permanently install one or more pumps or other components within a well.

In some embodiments, downhole pump system 100 can include a work service rig 200, an installation device 300 (also known as a mechanical riser assembly), electrical submersible pump(s) 400, a steam generator 500, and a mechanical steam pump 600. In some embodiments, a service line cable 110 connects mechanical steam pump 600 to steam generator 500, steam generator 500 to the lowest electrical submersible pump 400, a series of electrical submersible pumps 400 to each other, and the highest electrical submersible pump 400 to work service rig 200 through installation device 300.

In some embodiments, service line cable 110 delivers power to electrical submersible pumps 400 (e.g., via an electrical line disposed within service line cable 110). In some embodiments, service line cable 110 delivers power through the center of electrical submersible pumps 400. In some embodiments, service line cable 110 delivers power through an outer portion of electrical submersible pumps 400. In some embodiments, service line cable 110 delivers power on an outside of electrical submersible pumps 400. In some embodiments, service line cable 110 provides communication (e.g., data communication) between electrical submersible pumps 400. In some embodiments, service line cable 110 provides communication between work service rig 200 and electrical submersible pumps 400. In some embodiments, service line cable 110 comprises a conduit configured to deliver water from work service rig 200 to steam generator 500. In some embodiments, the conduit is configured to deliver steam from steam generator 500 to mechanical steam pump 600. In some embodiments, the conduit travels through the center of electrical submersible pumps 400. In some embodiments, the conduit travels through an outer portion of electrical submersible pumps 400. In some embodiments, the conduit travels outside of electrical submersible pumps 400 (e.g., travels around or bypasses electrical submersible pumps 400).

In some embodiments, downhole pump system 100 is configured to install and remove a series of electrical submersible pumps 400. In some embodiments, downhole pump system 100 uses work service rig 200 to store and install other components of downhole pump system 100 to remove fluids (e.g., oil, water, etc.) from a low-producing well 10, a process known as deliquification, and then to stimulate well 10 to increase production. For example, in some embodiments, electrical submersible pumps 400 can be used to remove fluids from a low-producing well 10. In some embodiments, operators of downhole pump system 100 identify where the fluid is located in vertical section 16 of well 10. In some embodiments, the lifting operation starts from the top of the identified fluid level and works downward into vertical section 16 of well 10. For example, electrical submersible pump 400 at the top of the fluid level can pump the fluid up to the next highest electrical submersible pump 400 in vertical section 16 of well 10. Electrical submersible pumps 400 can thus sequentially pump fluid out of vertical section 16 of well 10.

In some embodiments, electrical submersible pumps 400 are spaced at a defined distance, which can help each electrical submersible pump 400 perform the same amount of work to accomplish the total desired lift. In some embodiments, each electrical submersible pump 400 has an expandable bladder, as discussed in more detail below, which can provide a seal between the annulus of the well pipe and electrical submersible pump 400 to achieve a predetermined desired lifting capability.

In some embodiments, each electrical submersible pump 400 can help support the electrical submersible pump 400 directly above it. In some embodiments, each electrical submersible pump 400 can sense its workload condition and know when to turn on, resulting in a more efficient lifting operation.

When deliquification causes the wellhead pressure to increase to a desired level, downhole pump system 100 can stop electrical submersible pumps 400 and apply power to the steam generation system, which can include steam generator 500 and mechanical steam pump 600. In some embodiments, steam generator 500 and mechanical steam pump 600 can begin stimulation of horizontal section 14. In some embodiments, steam generator 500 is located in vertical section 16 above the entrance to horizontal section 14. In some embodiments, steam generator 500 creates steam, which can be utilized to drive mechanical steam pump 600. For example, downhole pump system 100 can determine the downhole pressure at the entrance to horizontal section 14 and create steam pressure with steam generator 500 and mechanical steam pump 600 to overpower the hydrostatic pressure. The steam can be directed into a turbine of mechanical steam pump 600 in a reverse flow, which creates a low pressure at the inlet of the turbine and a higher pressure at the exhaust, directing the high pressure upstream in the annulus.

Figure 22:
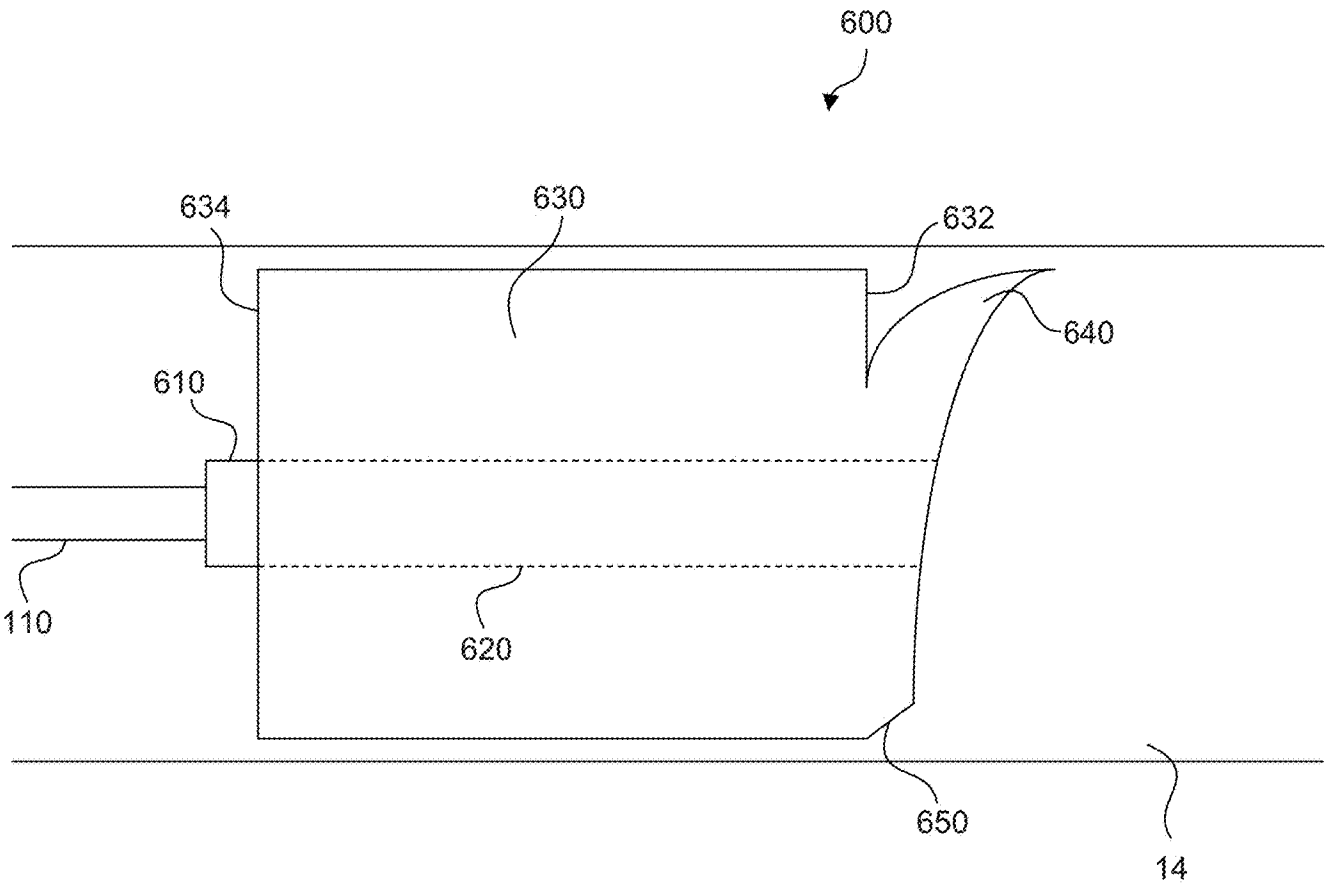
FIG. 22 illustrates a schematic of a mechanical steam pump according to some embodiments.

In some embodiments, this pressure differential stimulates horizontal section 14 with steam pressure, which can assist the exit of pressure from reservoir 12 by creating a low pressure zone at an inlet 632 of mechanical steam pump 600, as shown, for example, in FIG. 22, then moving product through the inlet above a projection, such as wing tip 640, in mechanical steam pump 600. The wing tip 640 can reduce the amount of heavy matter and debris disposed in horizontal section 14 that enters the inlet 632 of mechanical steam pump 600. By capturing the low viscosity fluids, mechanical steam pump 600 can accelerate the fluids upstream to vertical section 16. In some embodiments, mechanical steam pump 600 is designed to produce a pressure gradient at its location in horizontal section 14, with lower pressure at the inlet 632 and higher pressure at the exhaust 634. In some embodiments, the pressure gradient can be greater than two, such that the pressure at the exhaust 634 is at least two times the pressure at the inlet 632 of mechanical steam pump 600. Once the fluids reach vertical section 16, electrical submersible pumps 400 can provide lift of the combined fluids to production line 20. Additional details of the components and methods of downhole pump system 100 are provided below.

Figure 2:
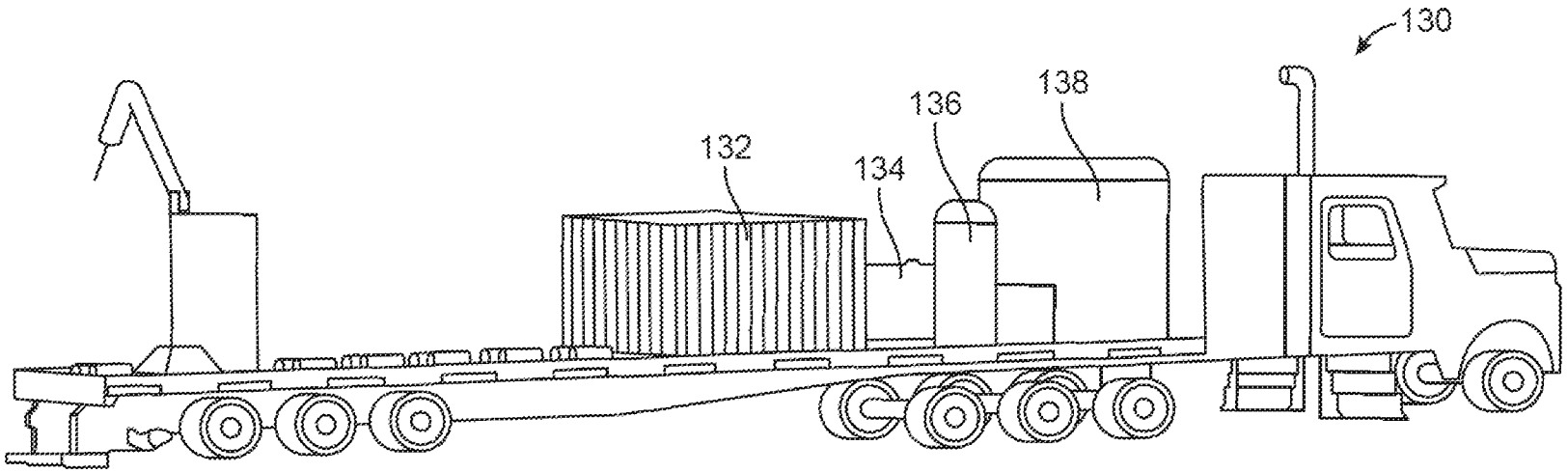
FIG. 2 illustrates an auxiliary service rig for a downhole pump system according to some embodiments.

In some embodiments, work service rig 200 is supported by an auxiliary service rig 130, as shown, for example, in FIG. 2. Auxiliary service rig 130 can transport work service rig 200 to low-producing wells in need of servicing. In some embodiments, auxiliary service rig 130 also supports supplemental components that assist in the operation of downhole pump system 100. In some embodiments, auxiliary service rig 130 can contain a high pressure hydraulic pump 132 containing accumulators and hydraulic fluid for driving installation device 300. In some embodiments, auxiliary service rig 130 contains a power generation unit 134. In some embodiments, power generation unit 134 can generate power independently. In some embodiments, power generation unit 134 generates high-voltage, AC/DC diesel power. Auxiliary service rig 130 can contain a compressor 136. In some embodiments, compressor 136 is a high cubic feet per meter compression unit. Auxiliary service rig 130 can contain a water storage tank 138. In some embodiments, water storage tank 138 holds a large volume of water. For example, in some embodiments, water storage tank 138 holds up to 150, 200, or 250 gallons of water. In some embodiments, water storage tank 138 includes a high-volume water pump. Water stored in water storage tank 138 can be supplied to steam generator 500 through service line cable 110.

Figure 3:
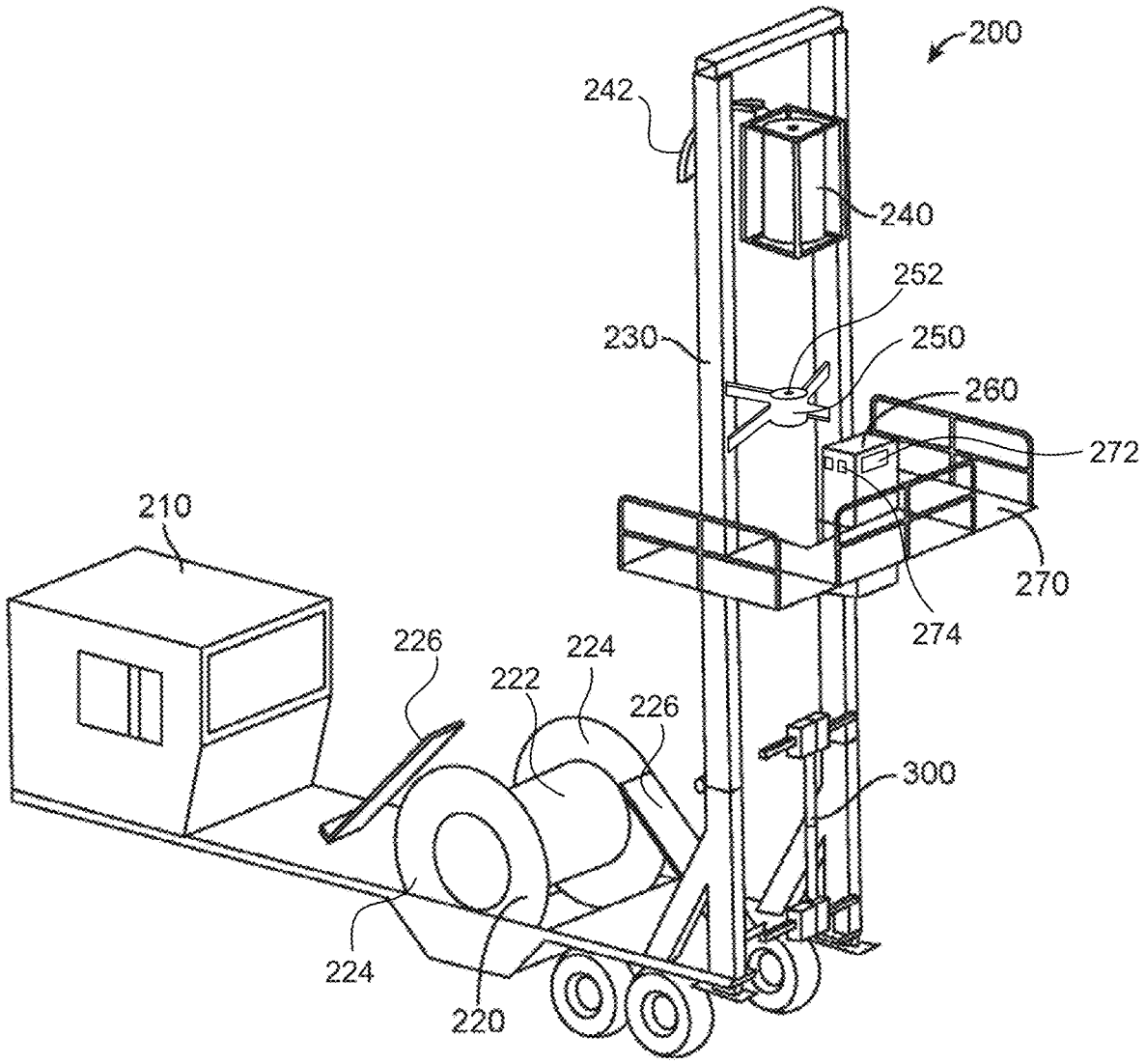
FIG. 3 illustrates a work service rig for a downhole pump system according to some embodiments.

In some embodiments, work service rig 200, as shown, for example, in FIG. 3, can include a control center 210, a service line spool 220, a mast 230, an injector system 240, a pump string support block 250, a tool/adaptor storage unit 260, a pump string operator platform 270, and installation device 300. Work service rig 200 can be in either a stored configuration for transport or an operating configuration for installation, operation, and removal of downhole pump system 100. FIG. 3 illustrates work service rig 200 in the operating configuration.

In some embodiments, control center 210 provides all the controls for operation of downhole pump system 100. In some embodiments, control center 210 controls the insertion, operation, and extraction processes of downhole pump system 100. For example, a user can control downhole pump system 100 from within control center 210. The operation of control center 210 (see FIGS. 7-11) and the associated user interface (see FIGS. 12 and 13) are described in more detail below. In some embodiments, control center 210 is disposed on work service rig 200. In some embodiments, control center 210 is disposed at a front end of work service rig 200 (i.e., nearest the cab of auxiliary service rig 130). In some embodiments, control center 210 can include additional equipment, such as a communications antenna or weather equipment (not shown).

In some embodiments, service line spool 220 is also disposed on work service rig 200. In some embodiments, service line spool 220 is located behind control center 210 (i.e., farther from the cab of auxiliary service rig 130 than control center 210). In some embodiments, service line spool 220 is cylindrical. For example, service line spool 220 can include a cylindrical body 222 and two circular flanges 224 on opposite ends of cylindrical body 222.

Service line spool 220 can be configured to store service line cable 110 during transport or excess cable during use. In some embodiments, service line cable 110 coils around cylindrical body 222 between circular flanges 224. In some embodiments, service line spool 220 is configured to store up to 5,000 feet of service line cable 110. In some embodiments, service line spool 220 is configured to store up to 7,000 feet of service line cable 110. In some embodiments, service line spool 220 is configured to store up to 10,000 feet of service line cable 110. In some embodiments, circular flanges 224 are sized such that when service line cable 110 is stored on service line spool 220, circular flanges 224 extend beyond the outermost portion of service line cable 110. In some embodiments, the outermost portion of service line cable 110 extends beyond circular flanges 224.

In some embodiments, service line spool 220 rotates to dispense service line cable 110 for insertion into well 10. In some embodiments, only a portion of service line spool 220 rotates (e.g., only cylindrical body 222 rotates). In some embodiments, service line spool 220 is hydraulically operated. In some embodiments, service line spool 220 is pneumatically operated. In some embodiments, the operation of service line spool 220 is automatic. In some embodiments, manual override controls for the operation of service line spool 220 are provided, for example, in control center 210. In some embodiments, service line spool 220 includes a slip ring. In some embodiments, the slip ring provides an electrical connection to service line cable 110 and associated parts, such as electrical submersible pumps 400, thus allowing the system to operate. In some embodiments, service line spool 220 determines the amount of travel of service line cable 110. For example, service line spool 220 can use the number of rotations to determine how much of service line cable 110 has been dispensed. In some embodiments, service line spool 220 includes one or more beams 226 to assist in maintaining service line cable 110 in place on service line spool 220.

In some embodiments, mast 230 sits above service line spool 220 when work service rig 200 is in the stored configuration. Thus, in the stored configuration, mast 230 is generally parallel with the ground. In the operating configuration, mast 230 can be generally perpendicular to the ground (i.e., upright). In some embodiments, mast 230 shifts between the stored configuration and the operating configuration through hydraulic power. In some embodiments, mast 230 shifts between the stored configuration and the operating configuration through pneumatic power. In some embodiments, mast 230 shifts between the stored configuration and the operating configuration automatically. In some embodiments, mast 230 shifts between the stored configuration and the operating configuration through manual operation.

In some embodiments, mast 230 supports other components of work service rig 200. For example, mast 230 can provide stowage for injector system 240, pump string support block 250, tool/adaptor storage unit 260, pump string operator platform 270, and installation device 300. In some embodiments, mast 230 can also carry cameras to provide a view of certain work areas around work service rig 200, which can be displayed in control center 210. In some embodiments, mast 230 is configured to support up to 50,000 pounds of weight. In some embodiments, mast 230 is configured to support up to 100,000 pounds of weight.

In some embodiments, injector system 240 is disposed near the top of mast 230 when mast 230 is upright in the operating configuration. In some embodiments, injector system 240 includes a track 242. Track 242 can support service line cable 110 and lead service line cable 110 into injector system 240. In some embodiments, track 242 is a gooseneck track. In some embodiments, injector system 240 is configured to insert and extract up to 50,000 pounds of service line cable 110 and associated parts, including electrical submersible pumps 400, steam generator 500, and mechanical steam pump 600. In some embodiments, injector system 240 draws service line cable 110 off of service line spool 220 as service line spool 220 rotates. In some embodiments, injector system 240 operates on hydraulic power.

In some embodiments, pump string support block 250 is disposed below injector system 240. Pump string support block 250 can include an opening 252 through which service line cable 110 extends. In some embodiments, opening 252 aligns service line cable 110 for insertion into installation device 300. In some embodiments, pump string support block 250 supports the portion of service line cable 110 that is downhole. In some embodiments, pump string support block 250 can support up to 65,000 pounds of weight. In some embodiments, pump string support block 250 can include sensors. For example, pump string support block 250 can include a sensor to measure the weight supported by pump string support block 250. Pump string support block 250 can also include, for example, a sensor to detect whether pump string support block 250 is closed. In some embodiments, pump string support block 250 comprises a slip clamp to support service line cable 110.

Pump string support block 250 can secure service line cable 110 in place as an operator on pump string operator platform 270 attaches components to service line cable 110 for insertion into well 10. In some embodiments, pump string support block 250 allows for fine height adjustments to assist in securing components such as electrical submersible pumps 400, steam generator 500, and mechanical steam pump 600 at an appropriate place along service line cable 110. In some embodiments, the height adjustments can be manually operated.

Electrical submersible pumps 400, steam generator 500, and mechanical steam pump 600 can be stored near pump string support block 250. For example, tool/adaptor storage unit 260 can be disposed near pump string support block 250 and be configured to store electrical submersible pumps 400, steam generator 500, and mechanical steam pump 600. In some embodiments, tool/adaptor storage unit 260 can also store service line connectors (such as the connectors disclosed in U.S. application Ser. No. 15/298,730 filed Oct. 20, 2016, the disclosure of which is incorporated in its entirety by reference thereto) and additional tools that assist in securing components to service line cable 110, such as hand tools.

Both pump string support block 250 and tool/adaptor storage unit 260 can be disposed above pump string operator platform 270 so that they are at a convenient height for an operator to secure components to service line cable 110. In some embodiments, pump string operator platform 270 is adjustable. For example, pump string operator platform 270 can be adjusted to accommodate different sizes of production trees 18. In addition, pump string operator platform 270 can be adjusted to accommodate different heights of operators.

In some embodiments, pump string operator platform 270 partially surrounds service line cable 110. For example, pump string operator platform 270 can surround service line cable 110 on three sides, thus providing 270 degrees of movement around service line cable 110. In some embodiments, pump string operator platform 270 includes a display panel 272. In some embodiments, pump string operator platform 270 includes operator controls 274. Display panel 272 and/or operator controls 274 can be provided on tool/adaptor storage unit 260 or can be provided on a separate structure.

Installation device 300 can be disposed on an end of mast 230 opposite from injector system 240. Thus, installation device 300 is disposed adjacent production tree 18. Service line cable 110 can pass from service line spool 220 through track 242, injector system 240, pump string support block 250, and pump string operator platform 270 to installation device 300. Installation device 300 is configured to pass service line cable 110 through production tree 18 into well 10 without stopping production.

Figure 4:
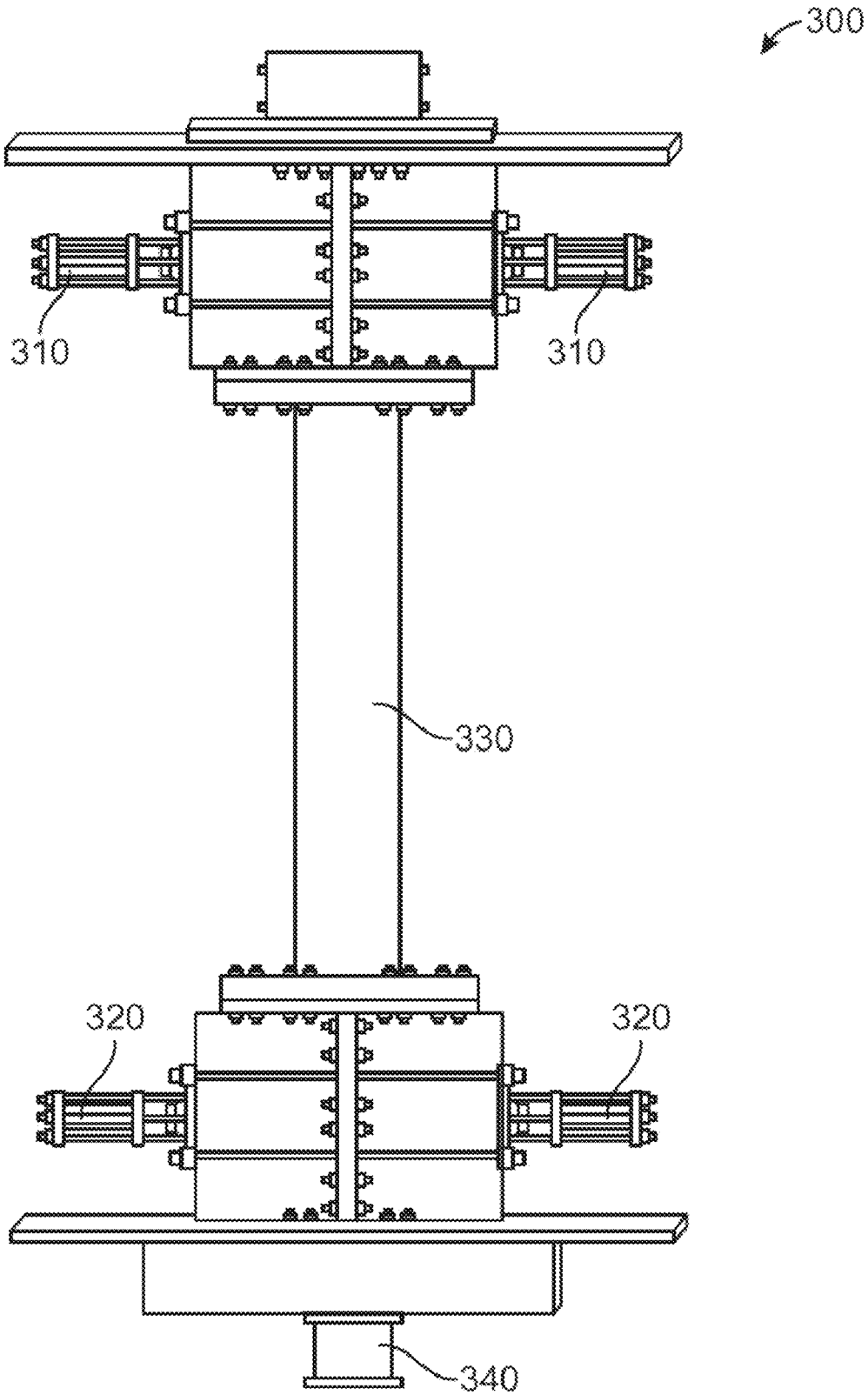
FIG. 4 illustrates an installation device according to some embodiments.
Figure 5:
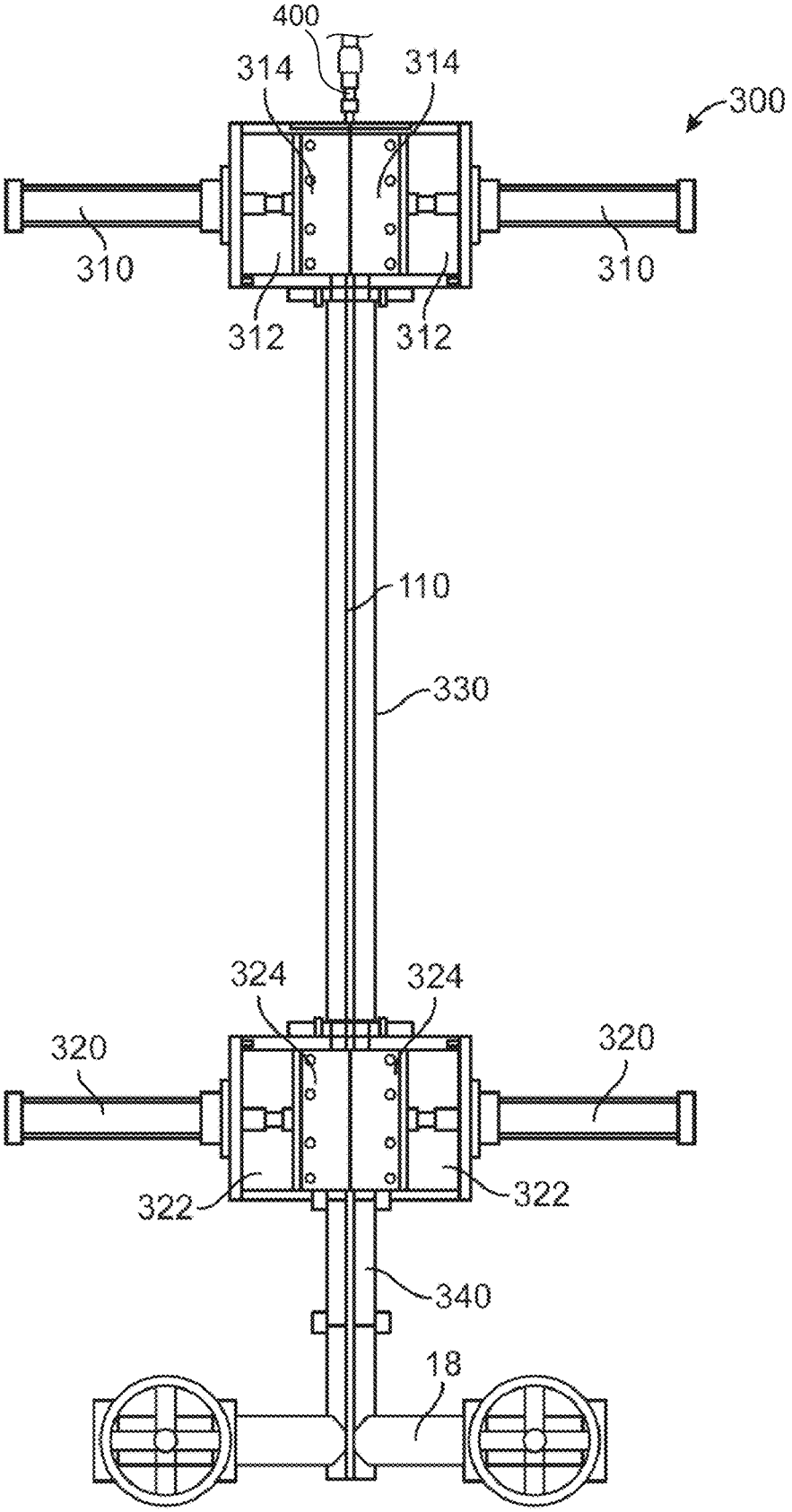
FIG. 5 illustrates a cross-sectional view of an installation device according to some embodiments.
Figure 6:
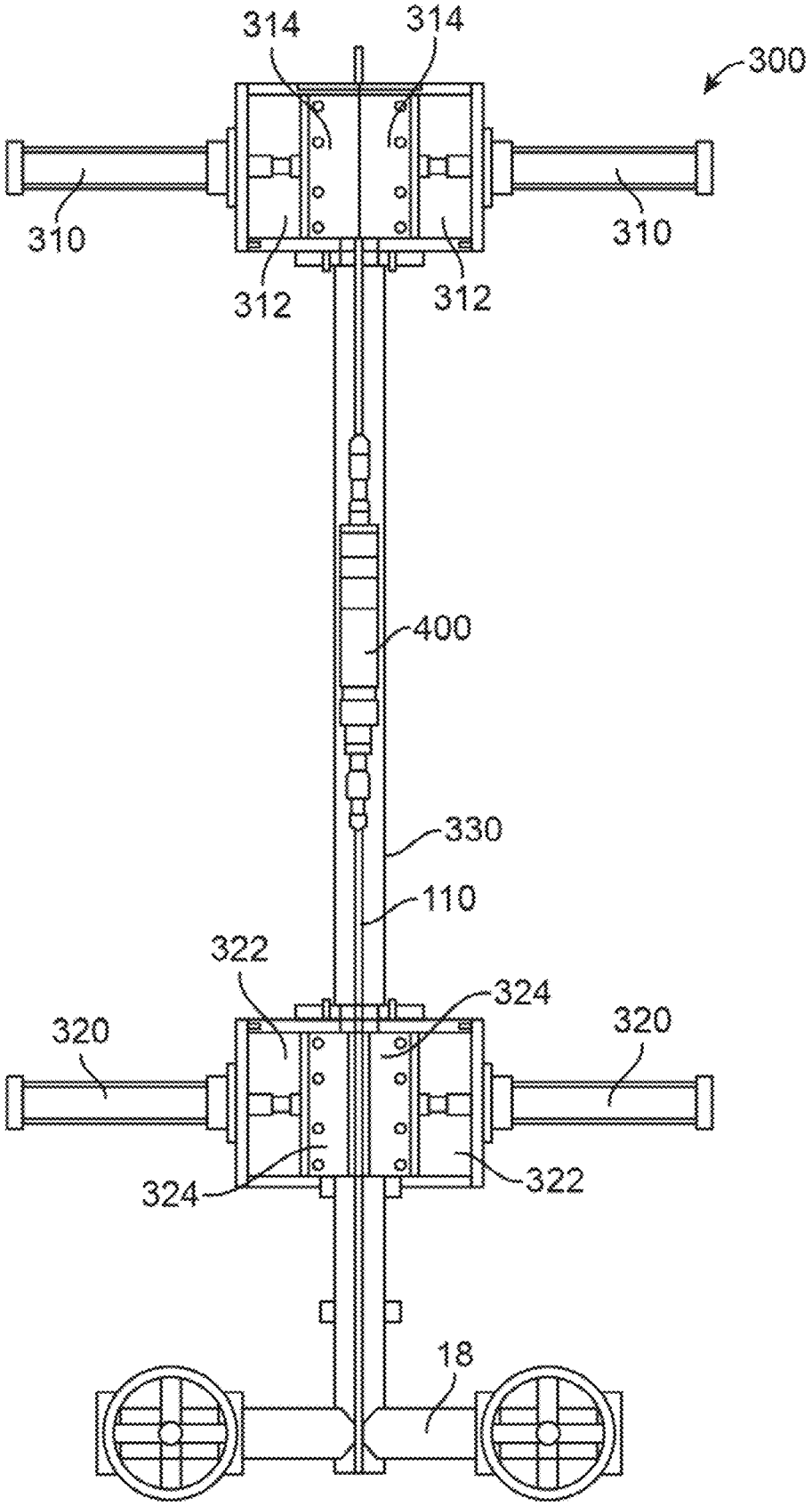
FIG. 6 illustrates a cross-sectional view of an installation device according to some embodiments.

In some embodiments, as shown, for example in FIGS. 4-6, installation device 300 includes upper pistons 310 and lower pistons 320. Upper pistons 310 can be disposed near the top of installation device 300 while lower pistons 320 can be disposed near the bottom of installation device 300. In some embodiments, installation device 300 includes a middle chamber 330 between upper pistons 310 and lower pistons 320. In some embodiments, installation device 300 includes a lower chamber 340 below lower pistons 320.

In some embodiments, as shown in FIG. 5, upper pistons 310 include upper piston blocks 314 and upper piston chambers 312. In some embodiments, upper pistons 310 move upper piston blocks 314 within upper piston chambers 312 to open and close upper pistons 310 (i.e., between an open position and a closed position). Similarly, lower pistons 320 include lower piston blocks 324 and lower piston chambers 322. In some embodiments, lower pistons 320 move lower piston blocks 324 within lower piston chambers 322 to open and close lower pistons 320 (i.e., between an open position and a closed position).

The operation of installation device 300 can be seen in FIGS. 5 and 6, for example. Installation device 300 is attached to production tree 18. In some embodiments, installation device 300 attaches to production tree at lower chamber 340. Installation device 300 can maintain the pressure of well 10.

When upper pistons 310 and lower pistons 320 are closed, as shown in FIG. 5, service line cable 110 is able to pass through installation device 300 and production tree 18 into well 10 while still maintaining the pressure of well 10. For example, installation device 300 can provide a conduit for service line cable 110 through upper piston blocks 314 and lower piston blocks 324 while maintaining a seal.

While the conduit allows service line cable 110 to pass through the conduit, the conduit is sized so that the pressure of well 10 is maintained by maintaining a seal around service line cable 110. But electrical submersible pumps 400, steam generator 500, and mechanical steam pump 600 are too large to fit through the conduit. Thus, upper pistons 310 and lower pistons 320 can open to allow insertion of the components into well 10. To maintain the pressure of well 10, the opening and closing of upper pistons 310 and lower pistons 320 can be done in a certain order. In some embodiments, the installation device 300 diverts pressure into well 10 or the production line 20 to control the pressure and to prevent gases from releasing into the atmosphere.

This will be described in relation to insertion of an electrical submersible pump 400. Service line cable 110 passes through installation device 300 until the next electrical submersible pump 400 arrives above upper pistons 310, as seen, for example, in FIG. 5. At this time, upper pistons 310 open by moving piston blocks 314 away from each other. Then, electrical submersible pump 400 passes into middle chamber 330. When electrical submersible pump 400 is within middle chamber 330, upper pistons 310 move piston blocks 314 together to close the top portion of installation device 300. In some embodiments, air is evacuated from middle chamber 330 after electrical submersible pump 400 is within middle chamber 330. Because middle chamber 330 is isolated from the outside environment, lower pistons 320 can now be opened while maintaining the pressure of well 10. Lower pistons 320 open by moving piston blocks 324 away from each other, as seen, for example, in FIG. 6. Then electrical submersible pump 400 passes into lower chamber 340. Electrical submersible pump can now be passed through production tree 18 and into well 10. This process repeats itself until all the components of downhole pump system 100 have been inserted into well 10. The reverse process can occur when removing downhole pump system 100 from well 10.

Figure 7:
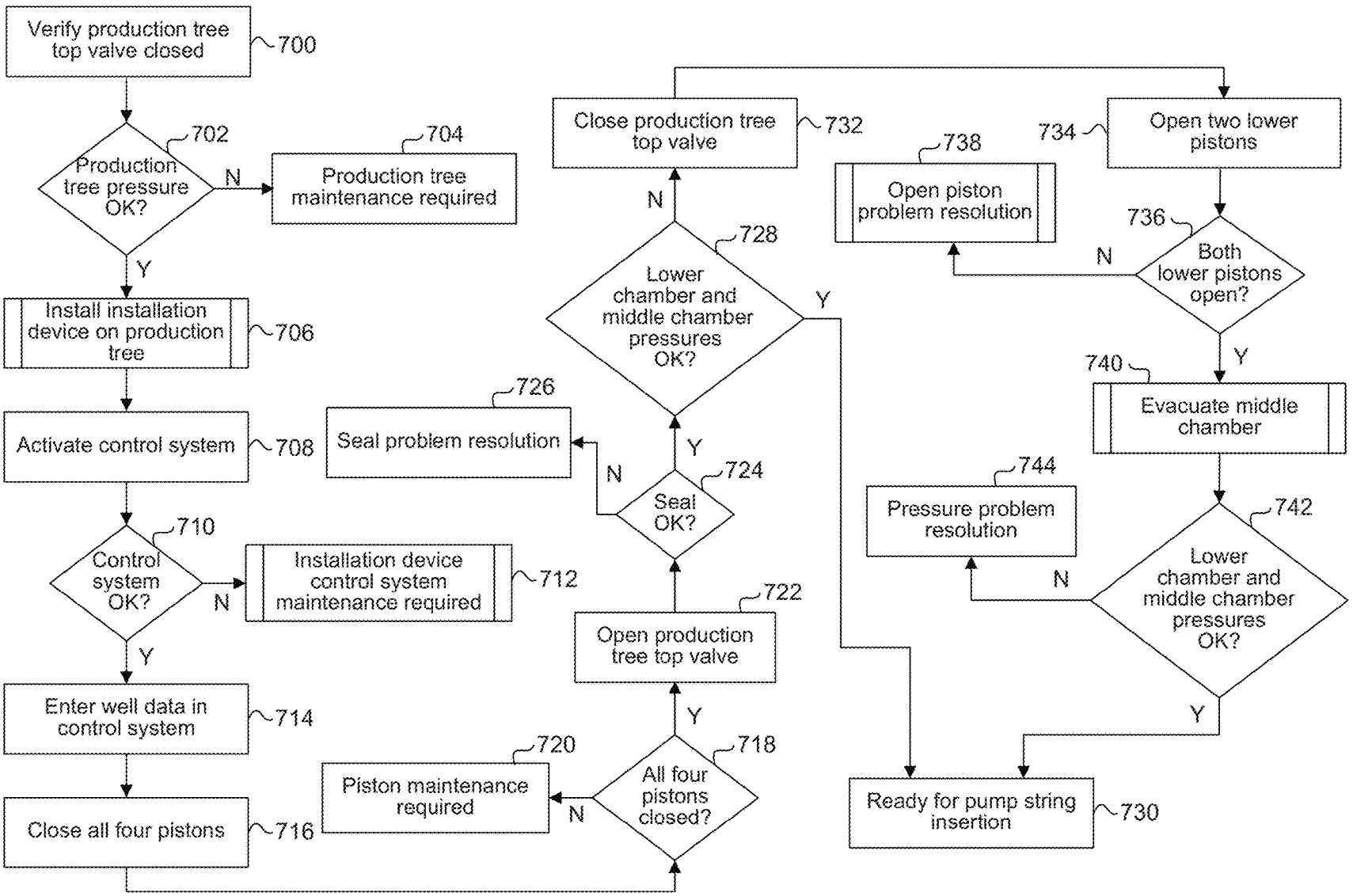
FIG. 7 illustrates a method of installing a downhole pump system according to some embodiments.

The process of attaching installation device 300 to production tree 18 is shown, for example, in FIG. 7. One or more of the operations can be done automatically by a control system of downhole pump system 100. One or more of the operations can be done manually. At operation 700, it is verified that the top valve of production tree 18 is closed. At operation 702, the pressure of production tree 18 is checked. If the pressure of production tree 18 is not at an appropriate level, then maintenance of production tree 18 is required at operation 704. If it is determined that the pressure of production tree 18 is appropriate at operation 702, then installation device 300 can be installed on production tree 18 at operation 706. A cap of production tree 18 can be removed to allow installation of installation device 300 onto production tree 18.

At operation 708, the control system of installation device 300 is activated. At operation 710, it is determined whether the control system of installation device 300 is functioning properly. In some embodiments, the control system of installation device 300 can include a built-in test to ensure the control system of installation device 300 is functioning properly. If it is determined that the control system of installation device 300 is not functioning properly, then maintenance is required either of the control system of installation device 300 or the installation device 300 itself at operation 712. However, if the control system of installation device 300 is functioning properly, data regarding the target well can be entered into the control system of installation device 300 at operation 714. For example, in some embodiments, the depth of the well, the production rate, etc. can be entered into the control system of installation device 300. In some embodiments, the control system of installation device 300 can determine which parts of downhole pump system 100 need to be installed based on this data. For example, the control system of installation device 300 can determine whether steam generator 500 and/or mechanical steam pump 600 need to be installed. As an additional example, the control system of installation device 300 can determine how many electrical submersible pumps 400 are required and the required length of service line cable 110.

At operation 716, all pistons, including upper pistons 310 and lower pistons 320 are closed. At operation 718, it is checked whether upper pistons 310 and lower pistons 320 are closed. If not, then maintenance of upper pistons 310 and/or lower pistons 320 is required at operation 720. If upper pistons 310 and lower pistons 320 are all closed, the top valve of production tree 18 is opened at operation 722.

After installation device 300 is attached to production tree 18 and the top valve of production tree 18 is opened, installation device 300 is checked for leaks at operation 724. In particular, the flange connecting installation device 300 to production tree 18 is checked for leaks to ensure that the seal between installation device 300 and production tree 18 is secure. If not, at operation 726, the seal problem is resolved before proceeding with the installation of downhole pump system 100. If there are no problems with the seal between installation device 300 and production tree 18, then the pressures in lower chamber 340 and middle chamber 330 are checked at operation 728. If the pressures in lower chamber 340 and middle chamber 330 are appropriate, then installation device 300 is ready to be used for insertion of service line cable 110 and other components of downhole pump system 100 at operation 730. The process of inserting these components is described more fully below in relation to FIG. 8.

If the pressures in lower chamber 340 and middle chamber 330 are not appropriate, then at operation 732, the top valve of production tree is closed. At operation 734, lower pistons 320 are opened. At operation 736 it is checked whether lower pistons 320 are open. If not, then the problem of opening lower pistons 320 is resolved at operation 738.

Once the lower pistons 320 are open, middle chamber 330 is evacuated at operation 740. At the end of evacuation of middle chamber 330, lower pistons 320 will be closed. The pressures in lower chamber 340 and middle chamber 330 are checked again at operation 742. If the pressures in lower chamber 340 and middle chamber 330 are now appropriate, then installation device 300 is ready to be used for insertion of the components of downhole pump system 100 at operation 730. If not, then the pressure problem is resolved at operation 744.

Figure 8:
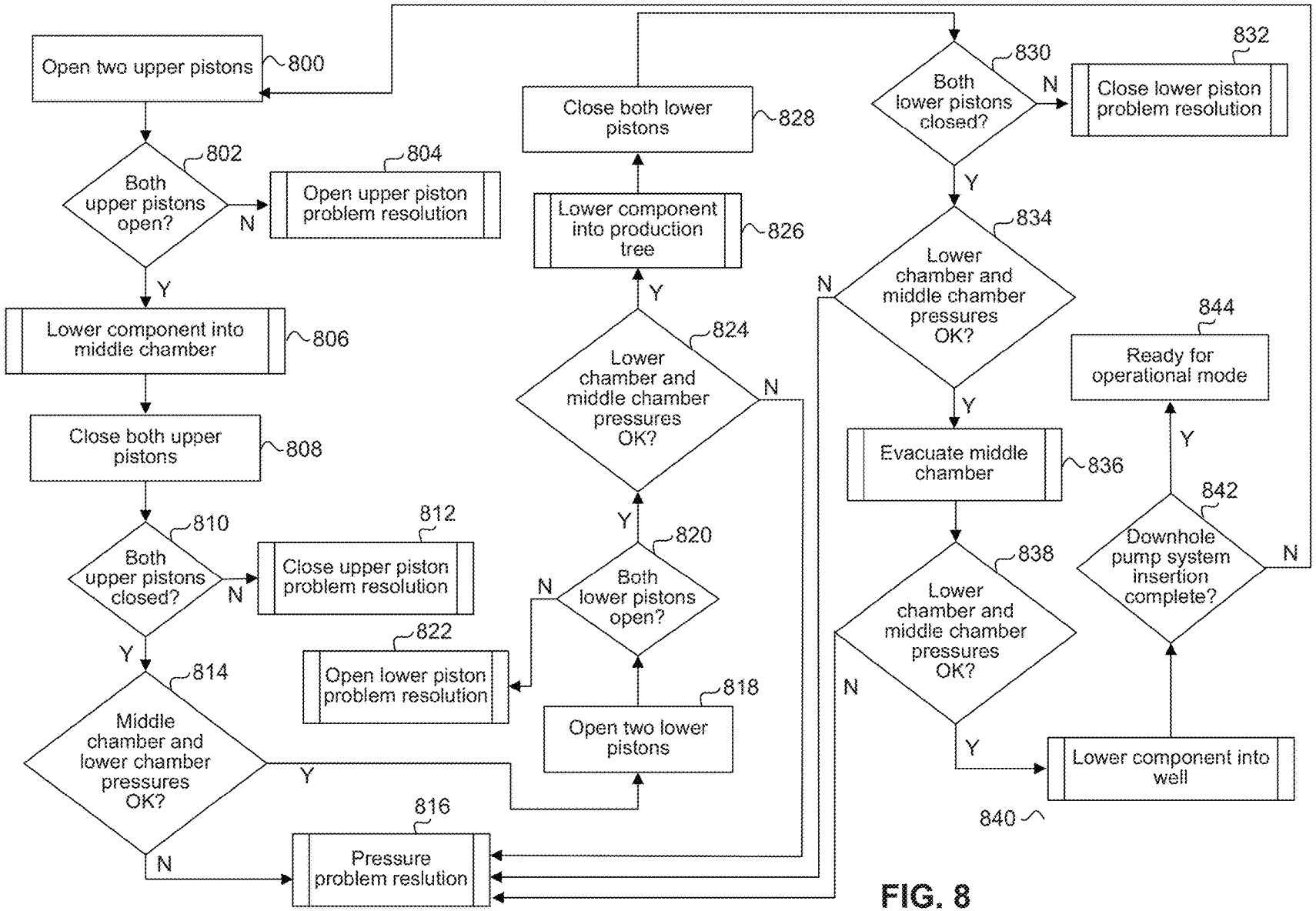
FIG. 8 illustrates a method of installing a downhole pump system according to some embodiments.

The process of installing components of downhole pump system 100 through installation device is shown, for example, in FIG. 8. One or more of the operations can be done automatically by a control system of downhole pump system 100. One or more of the operations can be done manually. At operation 800, upper pistons 310 are opened. At operation 802 it is checked whether upper pistons 310 are open. If not, then the problem of opening upper pistons 310 is resolved at operation 804. Once the upper pistons 310 are open, a component of downhole pump system 100 is lowered into middle chamber 330 at operation 806. The first component, for example, can be mechanical steam pump 600. Other components can include steam generator 500, electrical submersible pumps 400, or any other tool needing to be inserted into well 10. In some embodiments, mechanical steam pump 600 is the first pump installed into well 10. In some embodiments, steam generator is the second component installed into well 10. In some embodiments, electrical submersible pumps 400 are the last components installed into well 10.

At operation 808, upper pistons 310 are closed. At operation 810, it is checked whether upper pistons 310 are closed. If not, then the problem of closing upper pistons 310 is resolved at operation 812. Once the upper pistons 310 are closed, the pressures in lower chamber 340 and middle chamber 330 are checked at operation 814. If the pressures in lower chamber 340 and middle chamber 330 are not appropriate, then the pressure problem is resolved at operation 816. If the pressures in lower chamber 340 and middle chamber 330 are appropriate, then at operation 818, lower pistons 320 are opened. At operation 820 it is checked whether lower pistons 320 are open. If not, then the problem of opening lower pistons 320 is resolved at operation 822. Once the lower pistons 320 are open, the pressures in lower chamber 340 and middle chamber 330 are again checked at operation 824. If the pressures in lower chamber 340 and middle chamber 330 are not appropriate, then the pressure problem is resolved at operation 816. If the pressures in lower chamber 340 and middle chamber 330 are appropriate, then at operation 826, the component of downhole pump system 100 is lowered into production tree 18.

At operation 828, lower pistons 320 are closed. At operation 830, it is checked whether lower pistons 320 are closed. If not, then the problem of closing lower pistons 320 is resolved at operation 832. Once the lower pistons 320 are closed, the pressures in lower chamber 340 and middle chamber 330 are again checked at operation 834. If the pressures in lower chamber 340 and middle chamber 330 are not appropriate, then the pressure problem is resolved at operation 816. If the pressures in lower chamber 340 and middle chamber 330 are appropriate, then at operation 836, middle chamber 330 is evacuated.

After evacuation of middle chamber 330, the pressures in lower chamber 340 and middle chamber 330 are checked again at operation 838. If the pressures in lower chamber 340 and middle chamber 330 are not appropriate, then the pressure problem is resolved at operation 816. If the pressures in lower chamber 340 and middle chamber 330 are appropriate, then the component of downhole pump system 100 is lowered further into well 10 at operation 840. During operation 840, the pressures of lower chamber 340 and middle chamber 330 can continue to be monitored. If needed, middle chamber 330 can be evacuated again. The travel of service line cable 110 can also be monitored continuously.

At operation 842, it is determined whether insertion of downhole pump system 100 is complete (i.e., if all components of downhole pump system 100 have been installed). If not, then the process can start over at operation 800. If all components of downhole pump system 100 have been installed, then installation device 300 is ready for operational mode at operation 844, which is explained more fully in relation to FIG. 9. The pressures in lower chamber 340 and middle chamber 330 are checked throughout the installation process to assist in allowing installation without interfering with production of well 10, as well as protecting against release of gases into the atmosphere.

Figure 12:
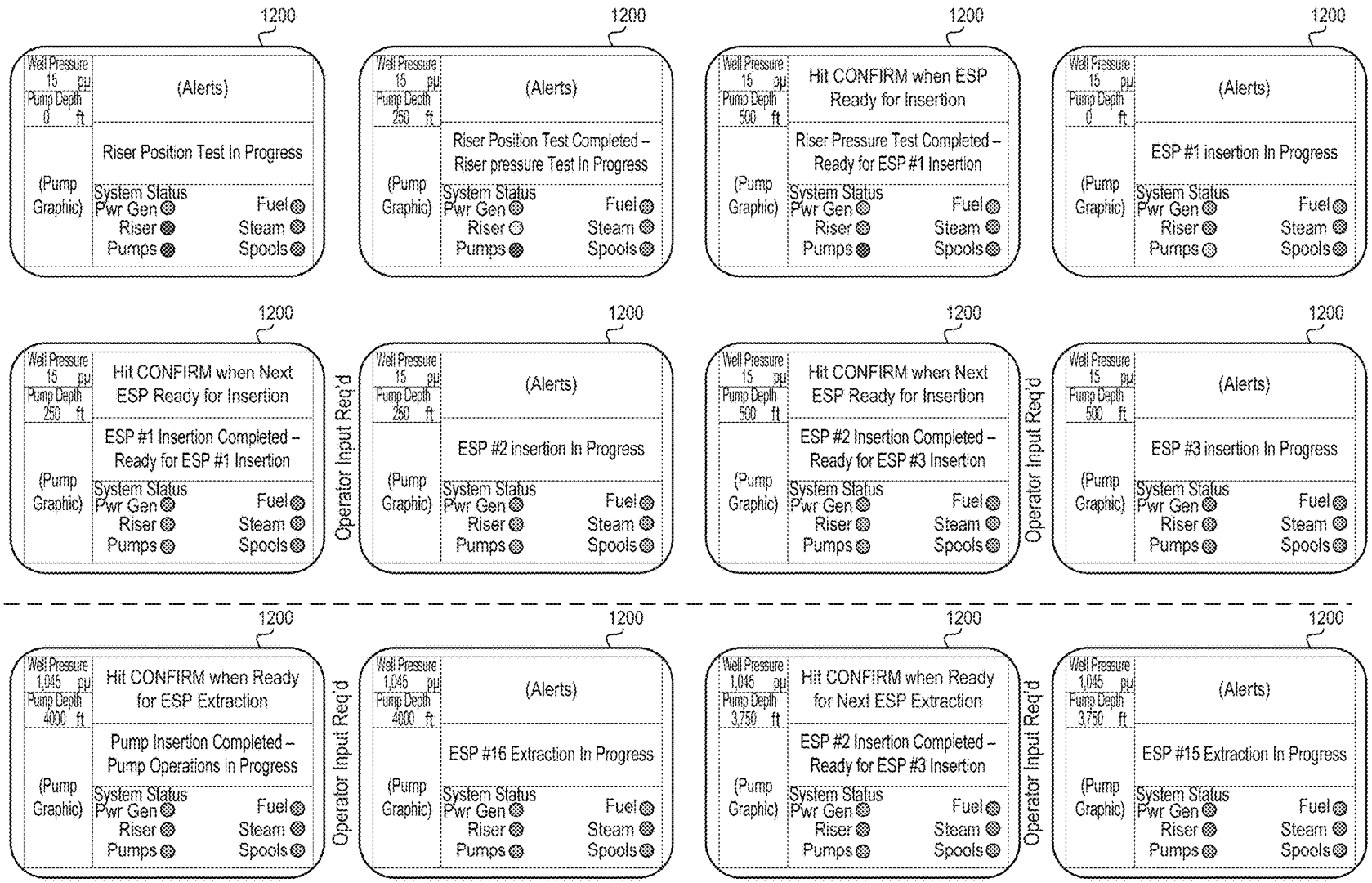
FIG. 12 illustrates a user interface of a downhole pump system according to some embodiments.

Example user interfaces 1200 that can be displayed to the operator in control center 210 and/or on display panel 272 during insertion of downhole pump system 100 are shown in FIG. 12.

Figure 9:
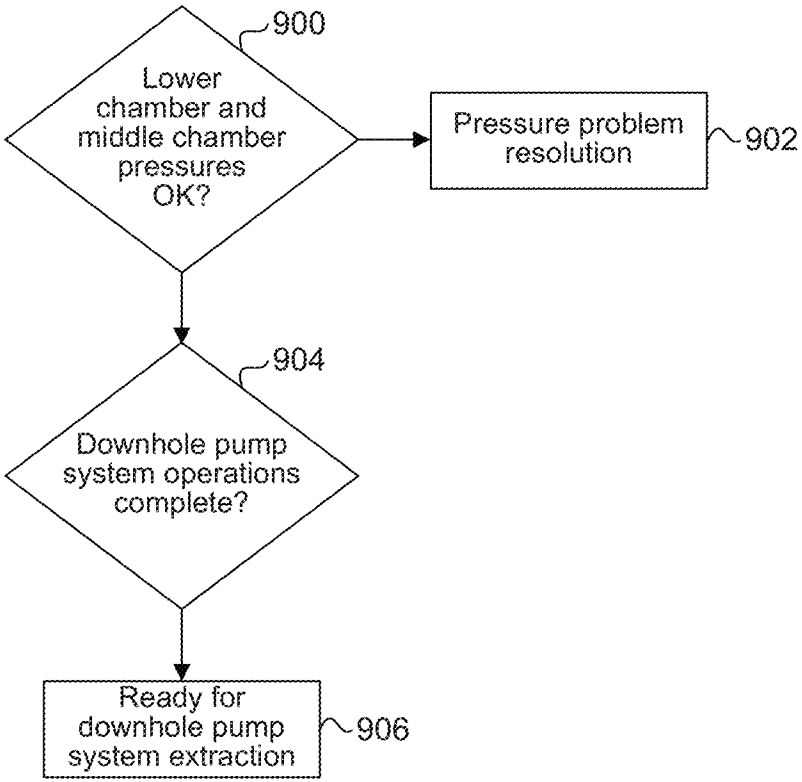
FIG. 9 illustrates a method of operation of a downhole pump system according to some embodiments.

The operational mode of installation device 300 is shown, for example, in FIG. 9. The operational mode of installation device 300 occurs as electrical submersible pumps 400 perform deliquification of vertical section 16 and as steam generator 500 and mechanical steam pump 600 stimulate horizontal section 14. At operation 900, the pressures in lower chamber 340 and middle chamber 330 are checked. If the pressures in lower chamber 340 and middle chamber 330 are not appropriate, then the pressure problem is resolved at operation 902. If the pressures in lower chamber 340 and middle chamber 330 are appropriate, then it is checked whether the operation of downhole pump system 100 is complete at operation 904. If not, then the process returns to operation 900. If the operations are complete, then the downhole pump system 100 is ready to be removed from well 10 at operation 906, which is explained more fully in relation to FIG. 10.

Figure 10:
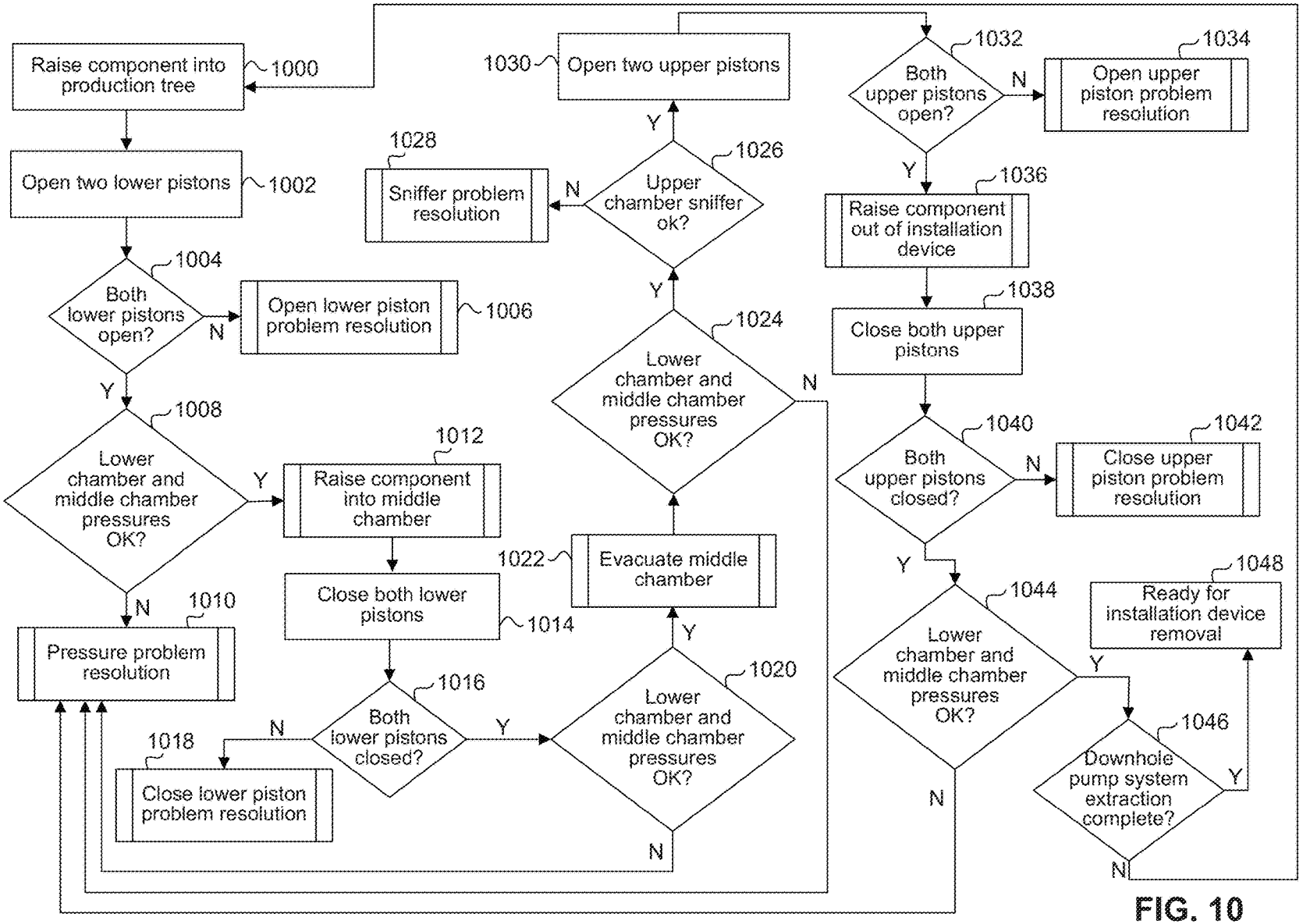
FIG. 10 illustrates a method of removing a downhole pump system according to some embodiments.

The process of removing downhole pump system 100 from well 10 through installation device 300 is shown, for example, in FIG. 10. At operation 1000, a component of downhole pump system 100 is raised out of well 10 and into production tree 18. During operation 1000, the pressures of lower chamber 340 and middle chamber 330 can continue to be monitored. If needed, middle chamber 330 can be evacuated. The travel of service line cable 110 can also be monitored continuously. At operation 1002, lower pistons 320 are opened. At operation 1004, it is checked whether lower pistons 320 are open. If not, then the problem of opening lower pistons 320 is resolved at operation 1006. Once the lower pistons 320 are open, the pressures in lower chamber 340 and middle chamber 330 are checked at operation 1008. If the pressures in lower chamber 340 and middle chamber 330 are not appropriate, then the pressure problem is resolved at operation 1010. If the pressures in lower chamber 340 and middle chamber 330 are appropriate, the component of downhole pump system 100 is raised into middle chamber 330 at operation 1012. The first component, for example, can be an electrical submersible pump 400. Other components can include steam generator 500, mechanical steam pump 600, or any other tool needing to be removed from well 10.

At operation 1014, lower pistons 320 are closed. At operation 1016, it is checked whether lower pistons 320 are closed. If not, then the problem of closing lower pistons 320 is resolved at operation 1018. Once the lower pistons 320 are closed, the pressures in lower chamber 340 and middle chamber 330 are checked at operation 1020. If the pressures in lower chamber 340 and middle chamber 330 are not appropriate, then the pressure problem is resolved at operation 1010. If the pressures in lower chamber 340 and middle chamber 330 are appropriate, then at operation 1022, middle chamber 330 is evacuated.

After evacuation of middle chamber 330, the pressures in lower chamber 340 and middle chamber 330 are checked again at operation 1024. If the pressures in lower chamber 340 and middle chamber 330 are not appropriate, then the pressure problem is resolved at operation 1010. If the pressures in lower chamber 340 and middle chamber 330 are appropriate, then a sniffer disposed in an upper chamber of installation device (i.e., above upper pistons 310) is checked to determine if any gases are present at operation 1026. If there is a problem (i.e., gas is detected), then the problem is resolved at operation 1028. Once it is confirmed that there are no problems, or the problems have been resolved, upper pistons 310 are opened at operation 1030. At operation 1032 it is checked whether upper pistons 310 are open. If not, then the problem of opening upper pistons 310 is resolved at operation 1034. Once the upper pistons 310 are open, the component of downhole pump system 100 is raised out of installation device 300 at operation 1036.

At operation 1038, upper pistons 310 are closed. At operation 1040, it is checked whether upper pistons 310 are closed. If not, then the problem of closing upper pistons 310 is resolved at operation 1042. Once the upper pistons 310 are closed, the pressures in lower chamber 340 and middle chamber 330 are again checked at operation 1044. If the pressures in lower chamber 340 and middle chamber 330 are not appropriate, then the pressure problem is resolved at operation 1010. If the pressures in lower chamber 340 and middle chamber 330 are appropriate, then at operation 1046, it is determined whether removal of downhole pump system 100 is complete (i.e., if all components of downhole pump system 100 have been removed). If not, then the process can start over at operation 1000. If all components of downhole pump system 100 have been removed, then installation device 300 is ready for removal at operation 1048, which is explained more fully in relation to FIG. 11. The pressures in lower chamber 340 and middle chamber 330 are checked throughout the removal process to assist in allowing removal without interfering with production of well 10, as well as protecting against release of gases into the atmosphere.

Figure 13:
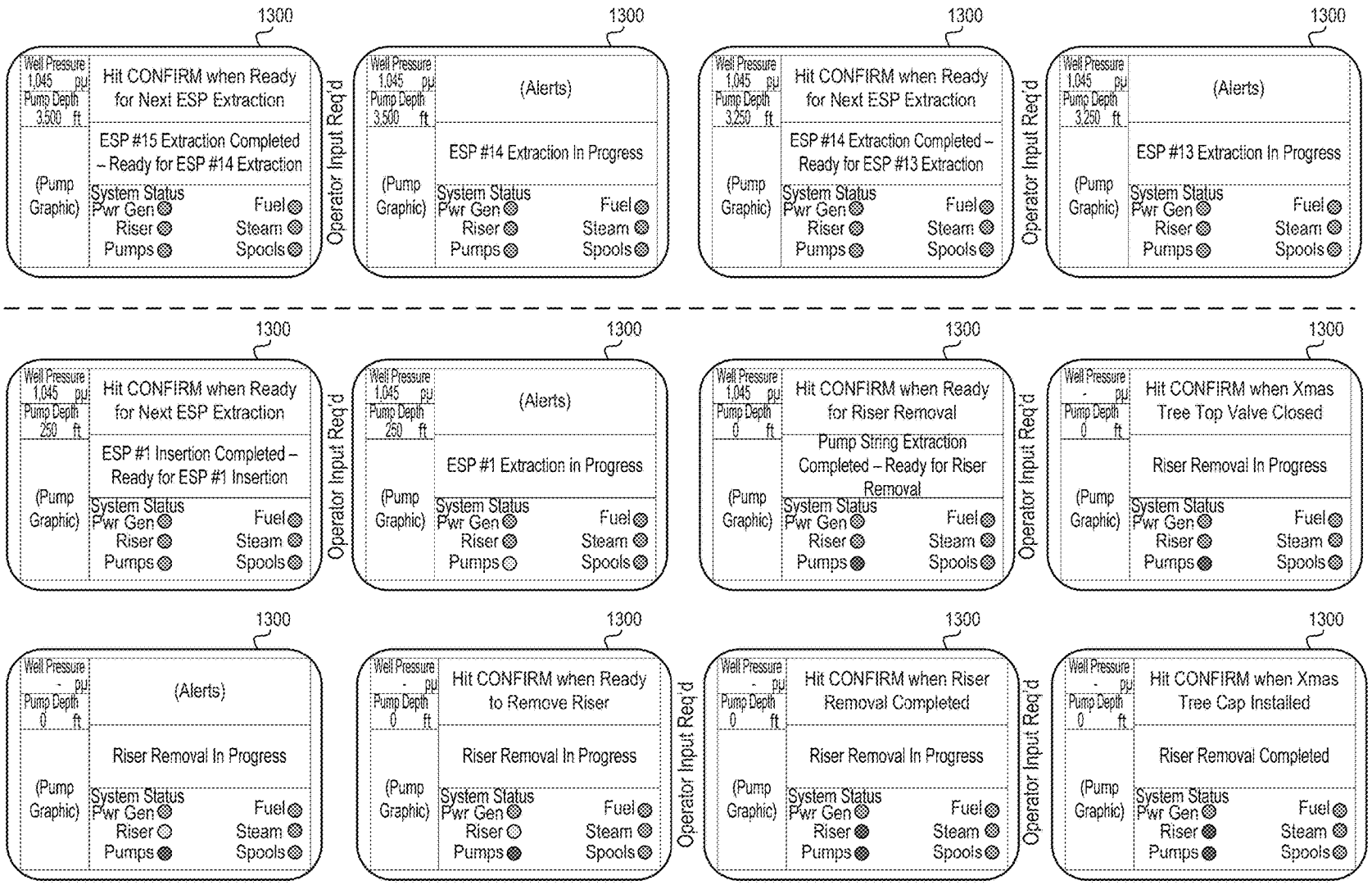
FIG. 13 illustrates a user interface of a downhole pump system according to some embodiments.
Figure 14:
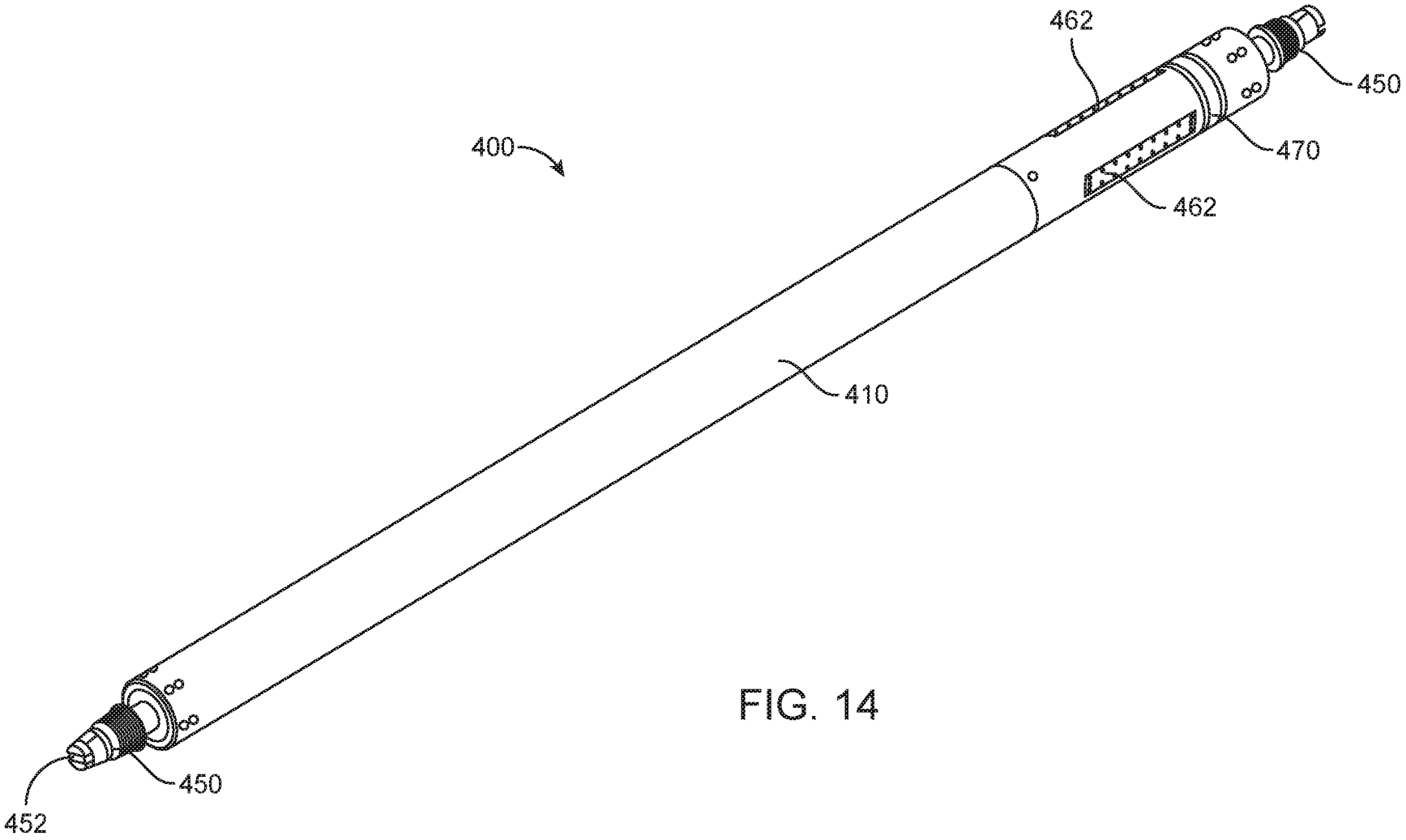
FIG. 14 illustrates an exterior view of an electrical submersible pump according to some embodiments.
Figure 15:
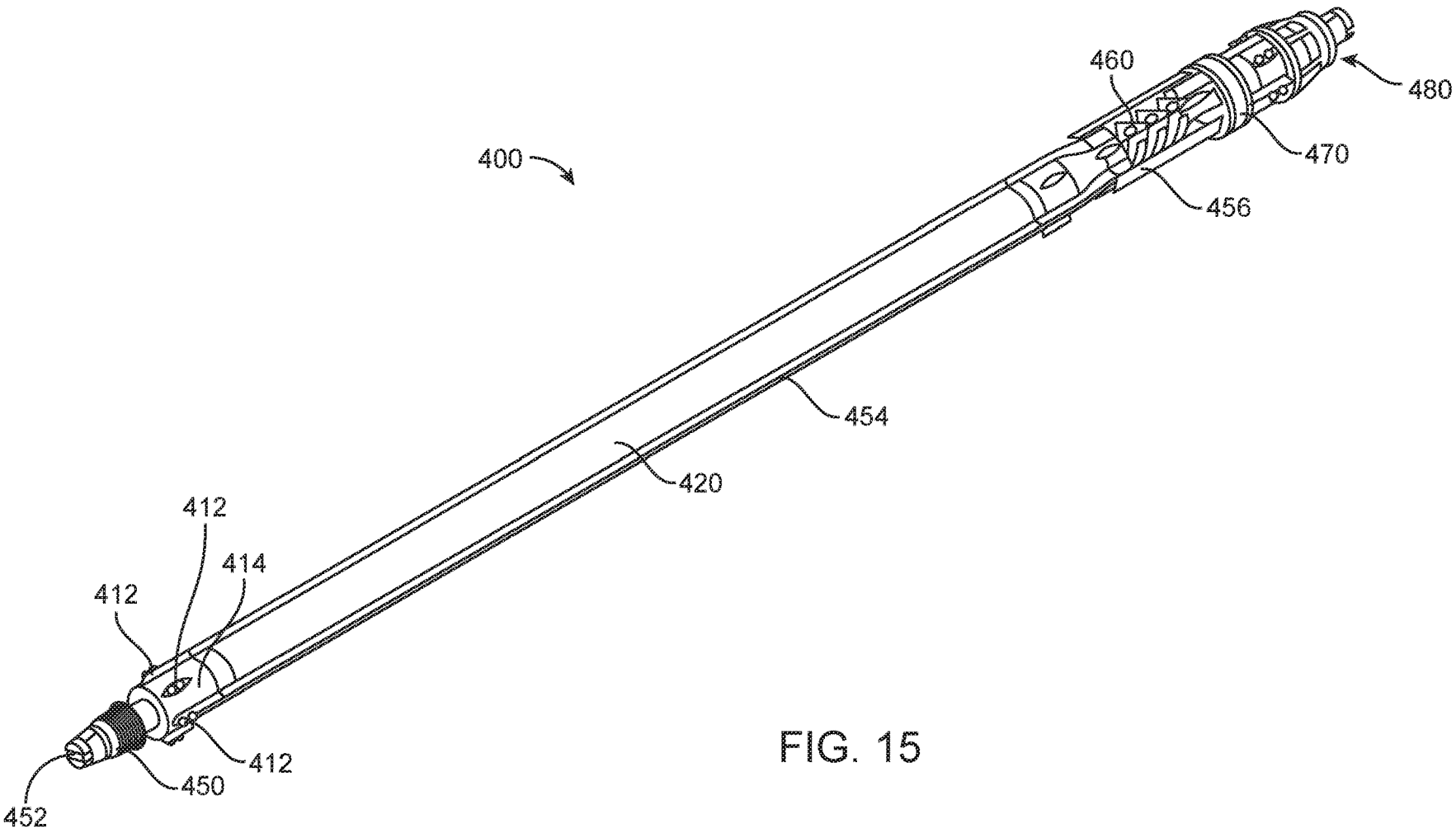
FIG. 15 illustrates an interior view of an electrical submersible pump according to some embodiments.
Figure 16:
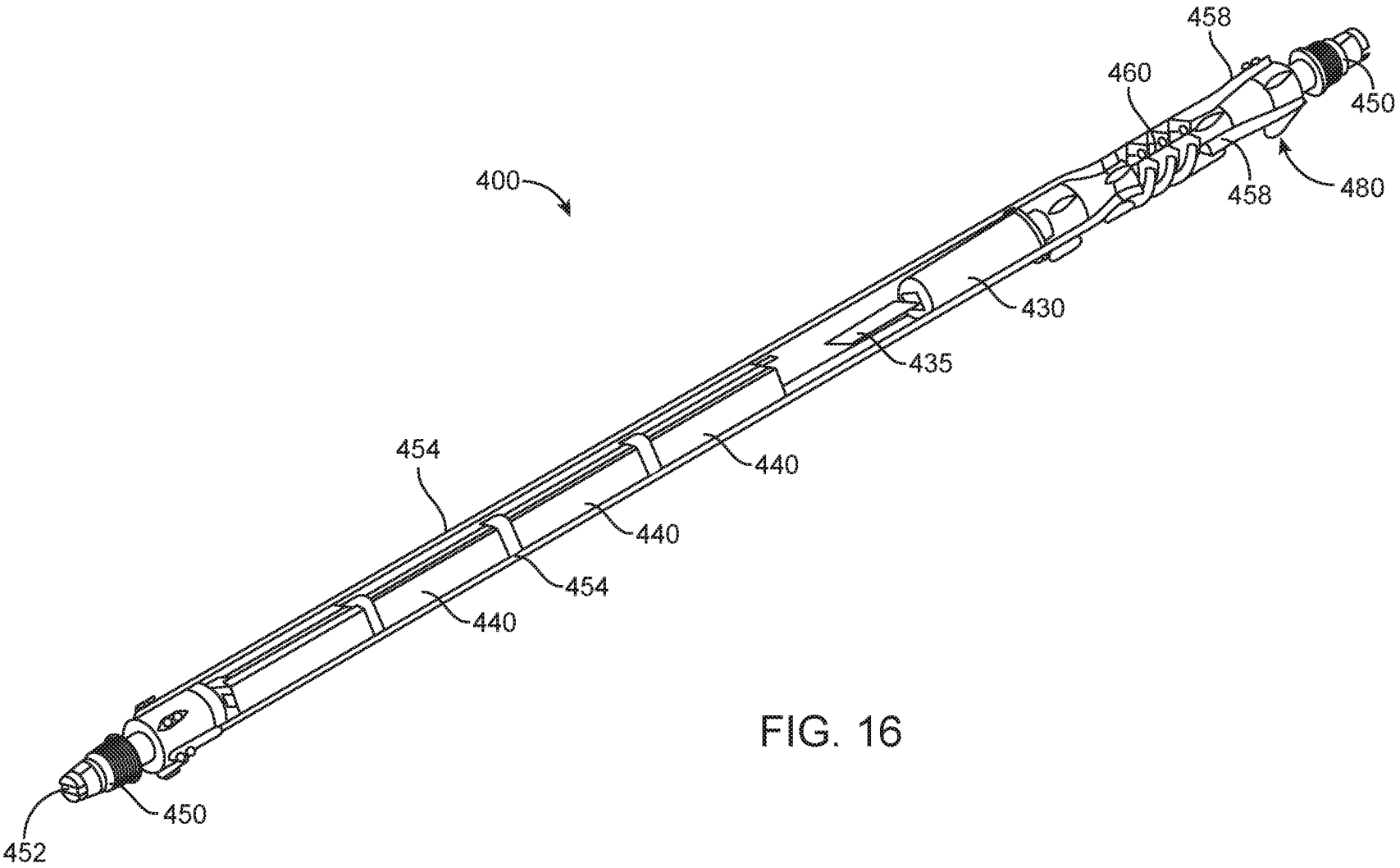
FIG. 16 illustrates an interior view of an electrical submersible pump according to some embodiments.
Figure 17:
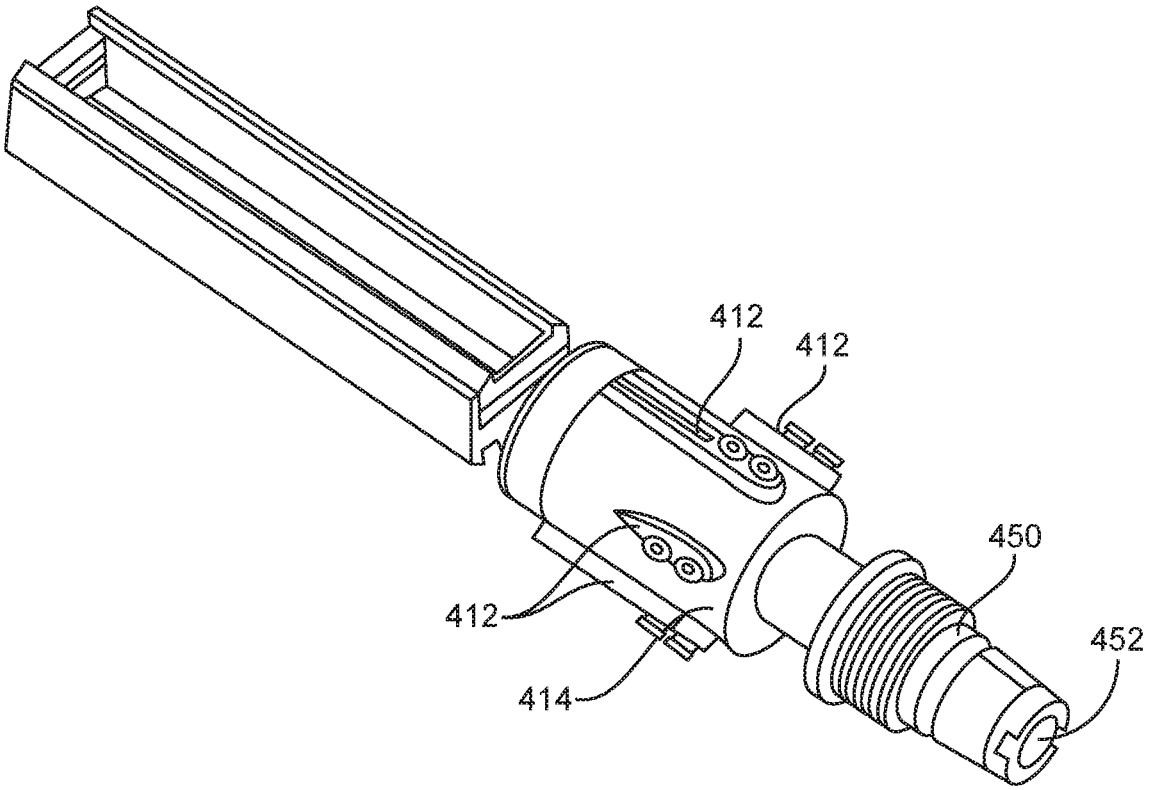
FIG. 17 illustrates an interior view of an electrical submersible pump according to some embodiments.
Figure 18:
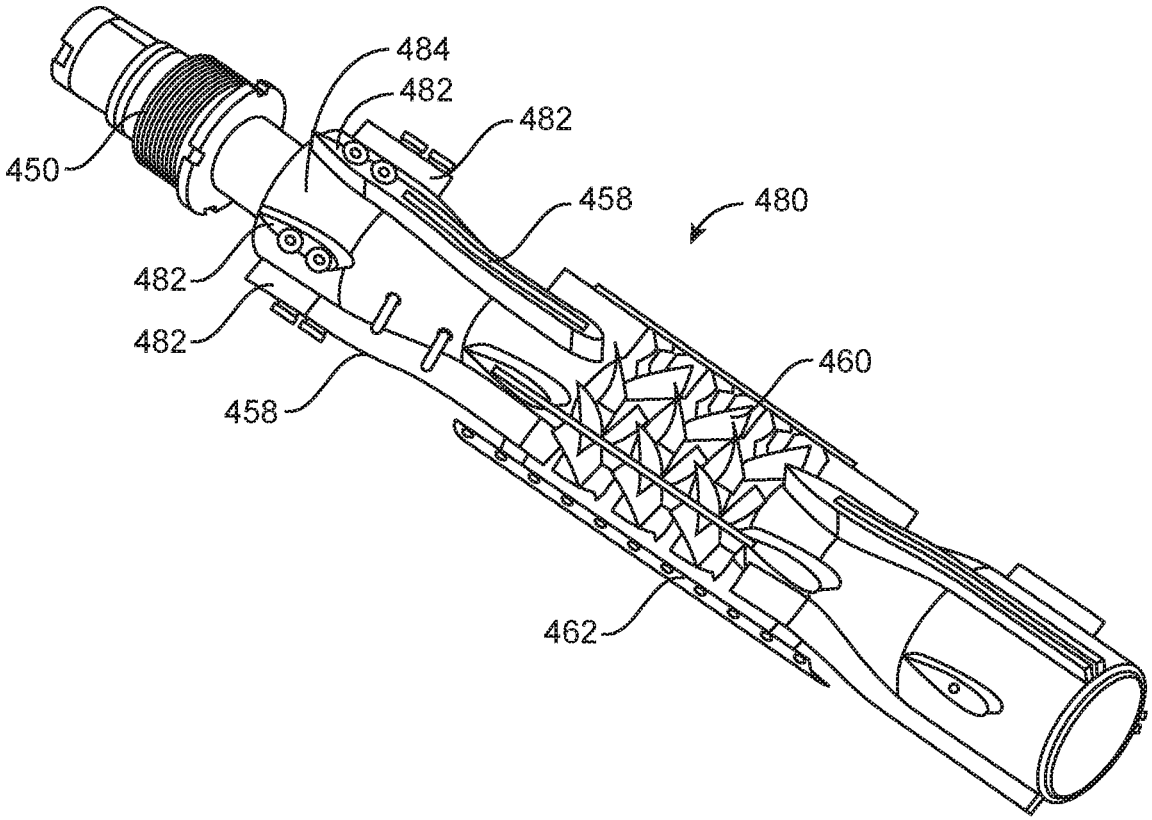
FIG. 18 illustrates an interior view of an electrical submersible pump according to some embodiments.
Figure 19:
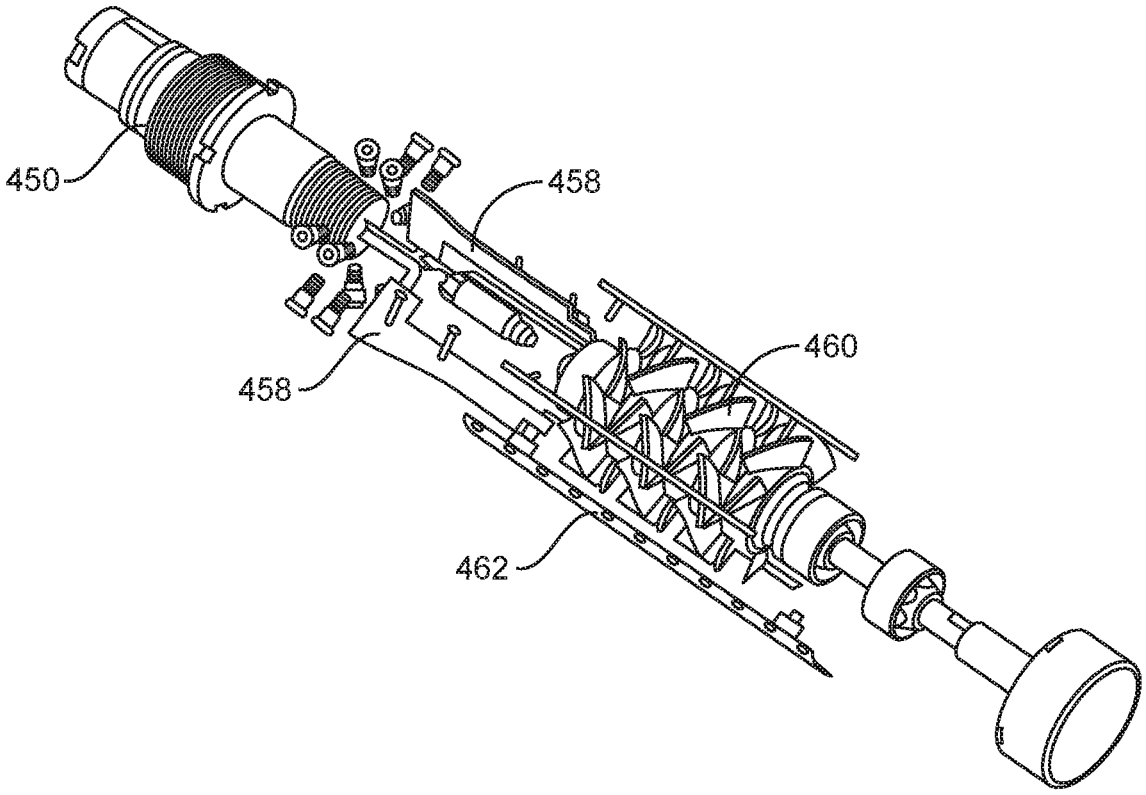
FIG. 19 illustrates an interior view of an electrical submersible pump according to some embodiments.
Figure 20:
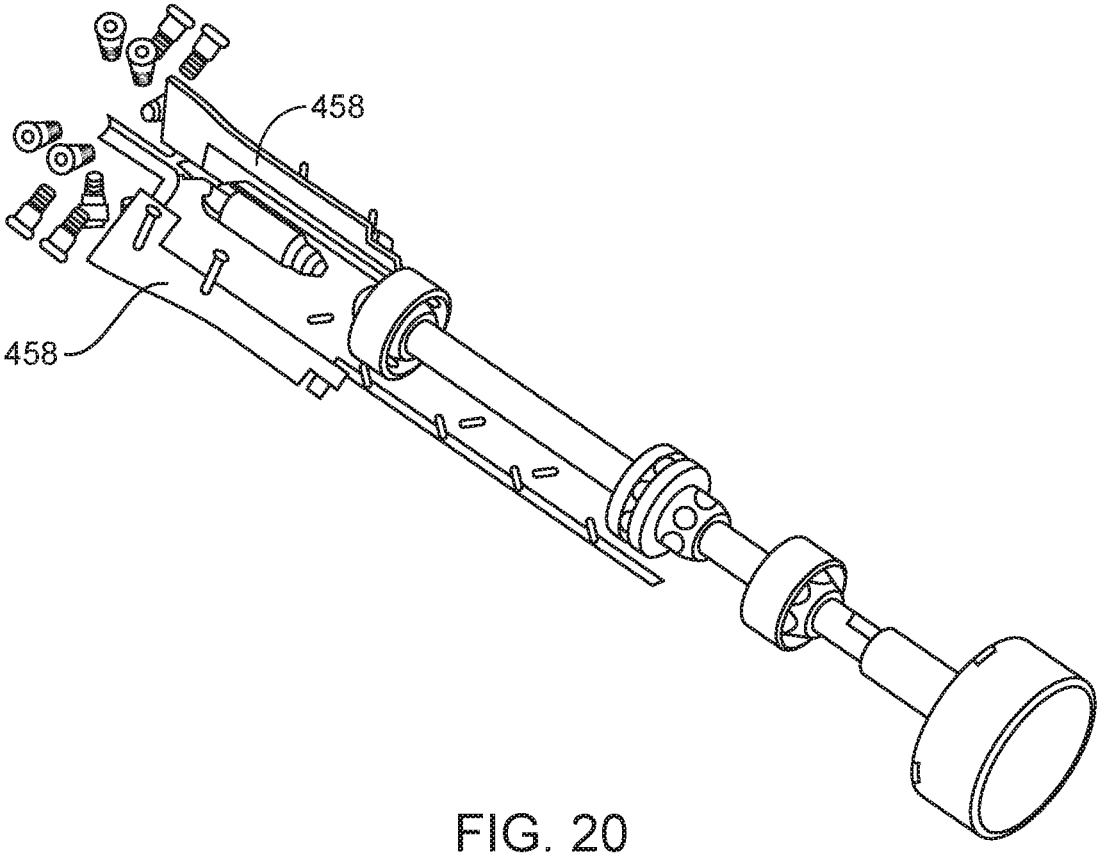
FIG. 20 illustrates an interior view of an electrical submersible pump according to some embodiments.

Example user interfaces 1300 that can be displayed to the operator in control center 210 and/or on display panel 272 during removal of downhole pump system 100 are shown in FIG. 13.

Figure 11:
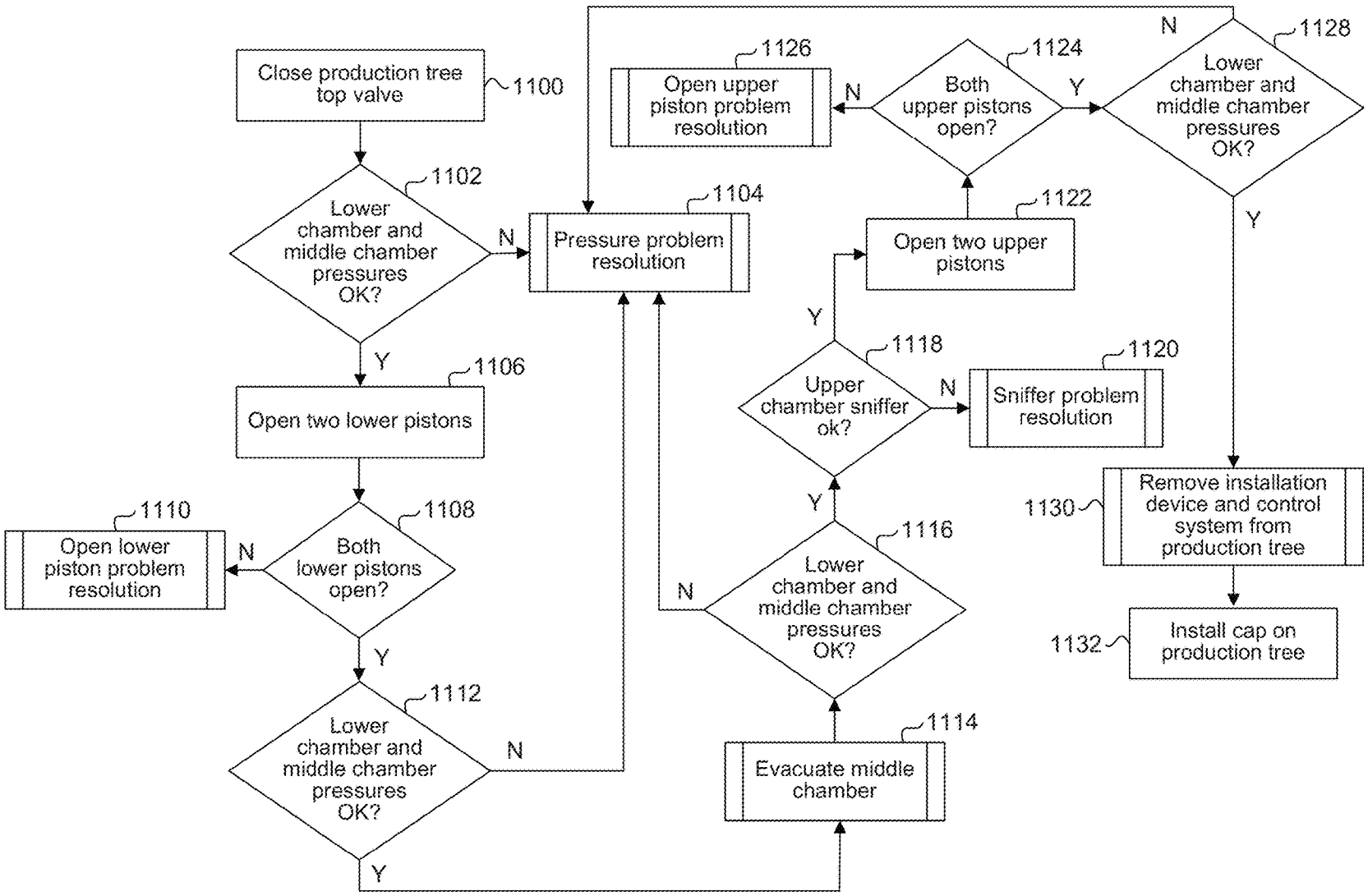
FIG. 11 illustrates a method of removing a downhole pump system according to some embodiments.

The process of removing installation device 300 from production tree 18 is shown, for example, in FIG. 11. At operation 1100, the top valve of production tree 18 is closed. At operation 1102, the pressures in lower chamber 340 and middle chamber 330 are checked. If the pressures in lower chamber 340 and middle chamber 330 are not appropriate, then the pressure problem is resolved at operation 1104. If the pressures in lower chamber 340 and middle chamber 330 are appropriate, then at operation 1106, lower pistons 320 are opened. At operation 1108 it is checked whether lower pistons 320 are open. If not, then the problem of opening lower pistons 320 is resolved at operation 1110. Once the lower pistons 320 are open, the pressures in lower chamber 340 and middle chamber 330 are again checked at operation 1112. If the pressures in lower chamber 340 and middle chamber 330 are not appropriate, then the pressure problem is resolved at operation 1104. If the pressures in lower chamber 340 and middle chamber 330 are appropriate, then at operation 1114, middle chamber 330 is evacuated.

After evacuation of middle chamber 330, the pressures in lower chamber 340 and middle chamber 330 are checked again at operation 1116. If the pressures in lower chamber 340 and middle chamber 330 are not appropriate, then the pressure problem is resolved at operation 1104. If the pressures in lower chamber 340 and middle chamber 330 are appropriate, then the sniffer disposed in the upper chamber of installation device (i.e., above upper pistons 310) is checked to determine if any gases are present at operation 1118. If there is a problem (i.e., gas is detected), then the problem is resolved at operation 1120. Once it is confirmed that there are no problems, or the problems have been resolved, upper pistons 310 are opened at operation 1122. At operation 1124 it is checked whether upper pistons 310 are open. If not, then the problem of opening upper pistons 310 is resolved at operation 1126.

Once the upper pistons 310 are open, the pressures in lower chamber 340 and middle chamber 330 are again checked at operation 1128. If the pressures in lower chamber 340 and middle chamber 330 are not appropriate, then the pressure problem is resolved at operation 1104. If the pressures in lower chamber 340 and middle chamber 330 are appropriate, then at operation 1130, installation device 300 and the control system of installation device 300 are removed from production tree 18. At operation 1132, the cap of production tree 18 is installed onto production tree 18. Downhole pump system 100 can then be driven to another location to increase the production of another well.

Various components of downhole pump system 100 will now be described in more detail. Variations and embodiments of these components can be used in any combination in the overall downhole pump system 100 and its operation as described above.

In some embodiments, service line cable 110 combines various components of downhole pump system 100. In some embodiments, service line cable 110 provides a physical connection between each electrical submersible pump 400, steam generator 500, and mechanical steam pump 600. In some embodiments, service line cable 110 delivers electrical power, electrical signals (i.e., digital communication), and/or water to one or more of the electrical submersible pumps 400, steam generator 500, and mechanical steam pump 600. In some embodiments, service line cable 110 comprises coiled tubing. In some embodiments, service line cable 110 comprises an umbilical cable. For example, service line cable 110 can include a plurality of sections that can be disconnected and connected to each other. These sections can facilitate attachment of electrical submersible pumps 400, steam generator 500, and mechanical steam pump 600 onto service line cable 110. In some embodiments, connectors can attach sections of service line cable 110.

In some embodiments, service line cable 110 has an outer diameter of more than 2 inches (e.g., 2.5, 2.625, 2.75, 2.875, or 3 inches). In some embodiments, the connectors for service line cable 110 can have an outer diameter of 3 inches. In some embodiments, service line cable 110 is more than 5,000 feet long (e.g., 6,000, 7,000, or 8,000 feet). In some embodiments, service line cable 110 provides a conduit for water. In some embodiments, the outer diameter of the conduit is 1 inch. In some embodiments, at least a portion of service line cable 110 can be insulated. In some embodiments, at least a portion of service line cable 110 can be reinforced. In some embodiments, service line cable 110 is made of metal (e.g., steel).

In some embodiments, downhole pump system 100 can utilize a plurality of electrical submersible pumps 400. For example, downhole pump system 100 can use 2, 5, 10, 20, 25, or more electrical submersible pumps 400. In some embodiments, each electrical submersible pump 400 is configured to attach to service line cable 110. Electrical submersible pumps 400 can attach to service line cable 110 in series (see FIG. 1). In some embodiments, each electrical submersible pump 400 is spaced from an adjacent electrical submersible pump 400 at a defined distance. In some embodiments, the defined distance is between 100 and 300 feet. For example, the defined distance can be 250 feet. The defined distance can lead to each electrical submersible pump 400 performing approximately the same amount of work to accomplish the total desired lift.

In some embodiments, electrical submersible pump 400 has an outer diameter of between 2 and 5 inches. For example, electrical submersible pump 400 can have an outer diameter of 4 inches. In some embodiments, electrical submersible pump 400 has a length of between 4 and 7 feet. For example, electrical submersible pump 400 can have a length of 4.5, 5, or 6 feet. In some embodiments, electrical submersible pump 400 comprises a single stage pump.

In some embodiments, as shown, for example, in FIGS. 14-20, electrical submersible pump 400 comprises an outer housing 410. In some embodiments outer housing 410 comprises a composite material. In some embodiments, electrical submersible pump 400 includes an inner housing 420. In some embodiments, outer housing 410 and inner housing 420 form a conduit for the fluid from well 10 to flow through as electrical submersible pumps 400 operate to pump fluid out of well 10. In some embodiments, projections 412 from inner housing 420 form openings 414 through which fluid in well 10 enters the conduit between inner housing 420 and outer housing 410. In some embodiments, inner housing 420 houses electronics, such as a motor 430, a circuit board 435, and control unit(s) 440.

In some embodiments, electrical submersible pump 400 includes an attachment mechanism 450 on each end. In some embodiments, attachment mechanism 450 includes an electrical attachment 452, such as pin connectors. In some embodiments, electrical submersible pump 400 comprises electrical connectors 454, 456, and 458 along the length of electrical submersible pump 400 between each electrical attachment 452. Thus, electrical submersible pump 400 maintains electrical continuity along service line cable 110 and receives power to operate from service line cable 110. In some embodiments, attachment mechanism includes a mechanical attachment, such as a threaded portion. Thus, electrical submersible pump can be attached to and removed from service line cable 110 as downhole pump system 100 is installed into a well 10.

In some embodiments, an impeller 460 is disposed within outer housing 410. In some embodiments, outer housing 410 includes one or more doors 462 to provide access to impeller 460. In some embodiments, impeller 460 is powered by motor 430. In some embodiments, a bladder 470 is disposed upstream from impeller 460. In some embodiments, bladder 470 is made of rubber. In some embodiments, bladder 470 separates sections of the annulus of well 10 in vertical section 16 so that each electrical submersible pump 400 only needs to pump against the force of fluid in one section. In some embodiments, bladder 470 is inflatable to create a seal between different sections of service line cable 110.

In some embodiments, impeller 460 pumps the fluid through a diffuser 480. In some embodiments, diffuser 480 conditions the flow of the fluid as it exits electrical submersible pump 400. In some embodiments, diffuser 480 comprises projections 482 that form openings 484 through which fluid flows as it is pumped out of electrical submersible pump 400. In some embodiments, electrical submersible pumps 400 communicate with each other and/or control center 210. In some embodiments, electrical submersible pumps 400 can sense to begin pumping fluid (e.g., based on a sensed pressure).

Figure 21:
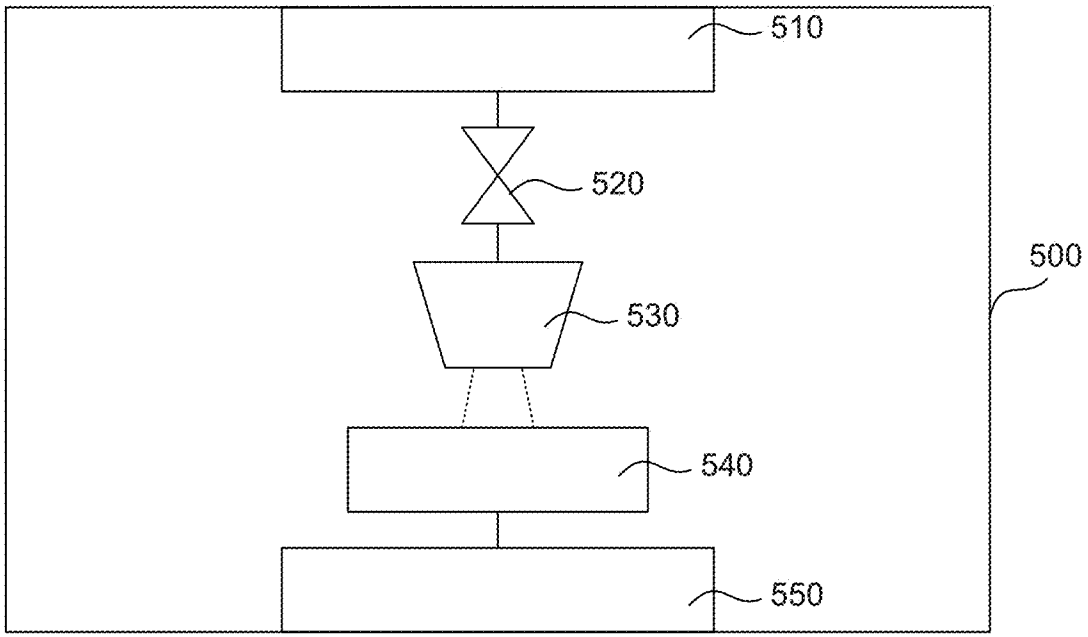
FIG. 21 illustrates a schematic of a steam generator according to some embodiments.

As noted above, electrical submersible pumps 400 operate to move fluid through vertical section 16. In some embodiments, electrical submersible pumps 400 operate until a certain percentage (e.g., 50%) of the fluid from vertical section 16 has been moved or until a sufficient pressure has been reached at the wellhead. In some embodiments, after this operation has been completed, electrical submersible pumps 400 can be deactivated and electrical power is provided to steam generator 500 and mechanical steam pump 600. In some embodiments, steam generator 500 comprises a heating element 540, as shown, for example, in FIG. 21. In some embodiments, electrical power is provided to heating element 540.

In some embodiments, water is passed through service line cable 110 and electrical submersible pumps 400 to steam generator 500. In some embodiments, water is passed to steam generator 500 on an outside of electrical submersible pumps 400. In some embodiments, steam generator 500 is located in vertical section 16 above the entrance to horizontal section 14. In some embodiments, steam generator 500 comprises an outer housing. In some embodiments, heating element 540 comprises a pipe or a coil. In some embodiments, the pipe or coil is made of metal. In some embodiments, heating element 540 comprises a ceramic material. For example, heating element 540 can include a ceramic insert inside a pipe to reduce corrosion. In some embodiments, steam generator 500 comprises an inlet 510 to receive water from service line cable 110. In some embodiments, steam generator 500 comprises a valve 520. In some embodiments, valve 520 remains closed until heating element 540 reaches a desired temperature (i.e., a temperature that can vaporize the water). In some embodiments, steam generator 500 comprises a nozzle 530. In some embodiments, when heating element 540 has reached the desired temperature, valve 520 is opened, which allows the water to pass through nozzle 530. In some embodiments, nozzle 530 is a spray nozzle. In some embodiments, nozzle 530 is disposed at the top of heating element 540. In some embodiments, nozzle 530 atomizes the spray. In some embodiments, heating element 540 causes the atomized spray to turn into steam. In some embodiments, steam generator comprises an outlet 550 to send the steam into service line cable 110 between steam generator 500 and mechanical steam pump 600.

In some embodiments, the steam is high-pressure steam that pressurizes service line cable 110, creating a pressure chamber. In some embodiments, the service line cable 110 between steam generator 500 and mechanical steam pump 600 has a length of 1,500 feet. In some embodiments, mechanical steam pump 600 comprises a high pressure float valve 610 at an entrance of mechanical steam pump 600, as shown, for example, in FIG. 22. In some embodiments, the steam drives mechanical steam pump 600. In some embodiments, mechanical steam pump 600 is disposed at the entrance of horizontal section 14.

In some embodiments, when the pressure of the steam reaches a pre-determined pressure (e.g., 3,000 pounds of pressure), float valve 610 will open. In some embodiments, the high pressure steam travels through conduit 620, causing turbine 630 to spin. As turbine 630 rotates, a low pressure region is created at inlet 632 of turbine 630. In some embodiments, the high pressure steam that exits from mechanical steam pump 600 stimulates the horizontal section 14. In some embodiments, the combination of the stimulation from the high pressure steam and the low pressure region at inlet 632, fluid (e.g., oil) in reservoir 12 will flow into inlet 632 and out of exhaust 634, driven by turbine 630, and sent up vertical section 16. In some embodiments, mechanical steam pump 600 comprises a wing tip 640. In some embodiments, wing tip 640 will block debris and thereby prevent the debris from clogging well 10. In some embodiments, mechanical steam pump 600 comprises a gap 650 that relieves back pressure.

Figure 23:
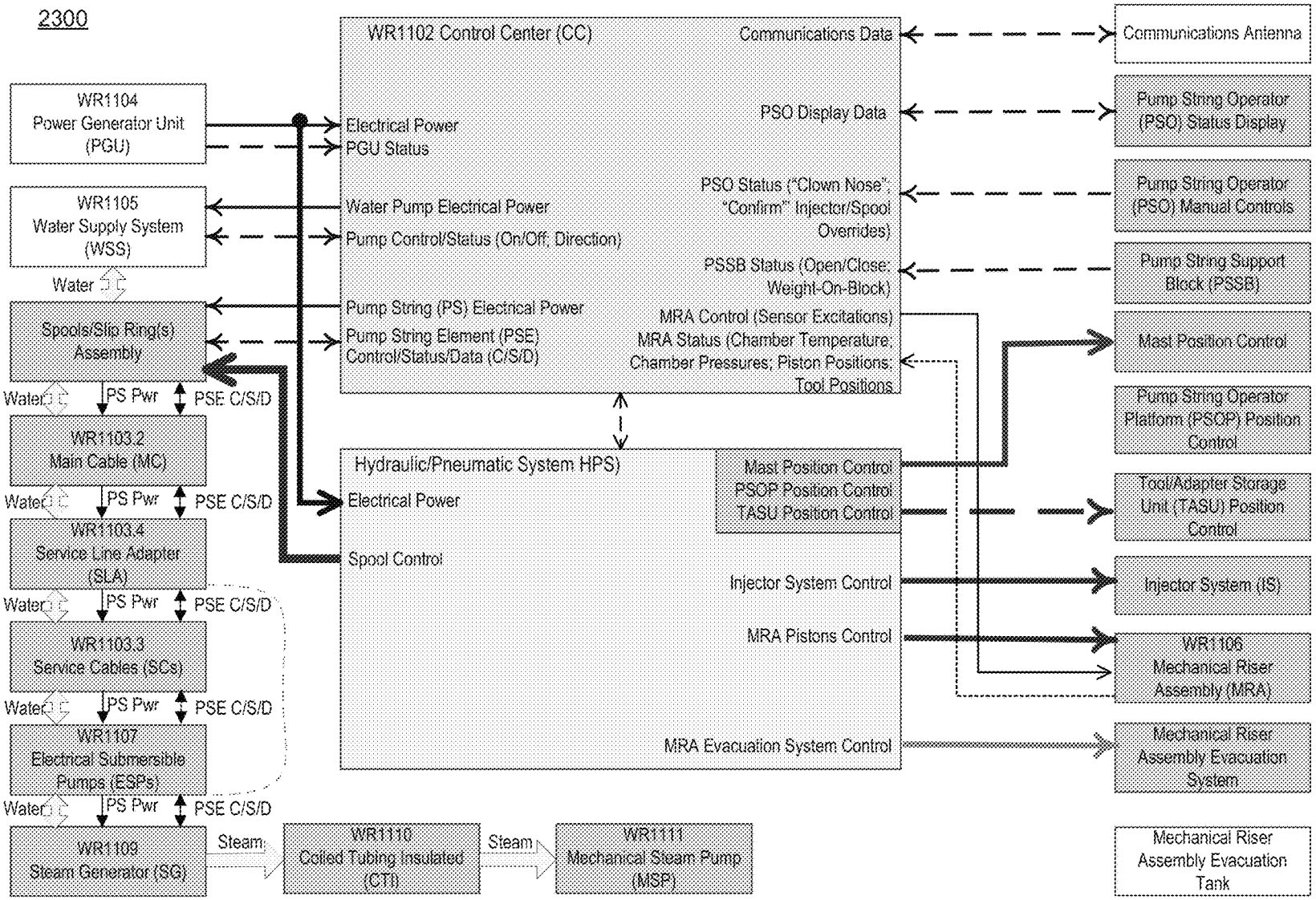
FIG. 23 illustrates a schematic view of operation of a downhole pump system according to some embodiments.

In some embodiments, as the fluid is sent back up vertical section 16, the lowest electrical submersible pump 400 can detect the pressure. In some embodiments, when the electrical submersible pump 400 detects the pressure, the power is diverted from steam generator 500 to electrical submersible pumps 400 to pump the fluid (e.g., oil) back up vertical section 16, thus increasing the production of well 10. Once the process has started, the production of well 10 will continue. In some embodiments, downhole pump system 100 can then be removed, as described above, and transported to another well 10 that needs increased production. A schematic view 2300 of the operation of downhole pump system 100 is shown, for example, in FIG. 23.

The foregoing description has been presented for purposes of illustration and description. It is not intended to be exhaustive or to limit the precise embodiments disclosed. Other modifications and variations may be possible in light of the above teachings.

The embodiments and examples were chosen and described in order to best explain the principles of the embodiments and their practical application, and to thereby enable others skilled in the art to best utilize the various embodiments with modifications as are suited to the particular use contemplated. By applying knowledge within the skill of the art, others can readily modify and/or adapt for various applications such specific embodiments, without undue experimentation, without departing from the general concept. Therefore, such adaptations and modifications are intended to be within the meaning and range of equivalents of the disclosed embodiments, based on the teaching and guidance presented herein.

What is claimed is:

1. A downhole pump system for increasing production of a well, the system comprising:

a steam pump disposed within a horizontal section of the well;

a steam generator disposed uphole from the steam pump;

a plurality of electrical pumps disposed and fluidically connected in series within a vertical section of the well above the steam generator; and a service line cable disposed between and connecting each of the steam pump, the steam generator, and the electrical pumps, the service line cable configured to deliver water downhole to the steam generator and steam from the steam generator to the steam pump, wherein the steam pump comprises a conduit for steam from the steam generator, a turbine configured to rotate as steam travels through the conduit, and an inlet disposed on a downhole end of the steam pump, wherein the steam pump is configured to create a low pressure region at the inlet such that fluid from the well flows through the inlet, and wherein the steam pump is configured to pump the fluid to the electrical pumps.

2. The system of claim 1, wherein the steam generator comprises a heating element and a nozzle disposed within an outer housing.

3. The system of claim 1, wherein the steam generator is disposed within a vertical section of the well.

4. The system of claim 1, wherein the service line cable provides power to the electrical pumps.

5. The system of claim 4, wherein the service line cable provides power through the electrical pumps.

6. The system of claim 1, wherein the service line cable provides communication between the electrical pumps.

7. The system of claim 1, wherein the service line cable provides communication between a work service rig and the electrical pumps.

8. The system of claim 7, wherein the service line cable comprises a service line conduit configured to deliver water from the work service rig to the steam generator and steam from the steam generator to the steam pump.

9. The system of claim 8, wherein the service line conduit travels through the electrical pumps.

10. The system of claim 1, wherein at least one of the electrical pumps comprises an expandable bladder configured to provide a seal between an annulus of the vertical section of the well and the electrical pump.

11. The system of claim 1, further comprising an installation device configured to attach to a production tree of the well, the installation device comprising:

two upper pistons;

two lower pistons;

a middle chamber disposed between the two upper pistons and the two lower pistons; and a lower chamber disposed below the two lower pistons, wherein the lower chamber is configured to attach to the production tree, wherein the two upper pistons are configured to shift between an open position and a closed position, wherein the open position allows the service line cable, the electrical pumps, the steam generator, and the steam pump to pass between the two upper pistons, and wherein the closed position seals the middle chamber from ambient air, and wherein the two lower pistons are configured to shift between an open position and a closed position, wherein the open position allows the service line cable, the electrical pumps, the steam generator, and the steam pump to pass between the two lower pistons, and wherein the closed position seals the lower chamber from the middle chamber.

12. The system of claim 1, wherein the downhole pump system is configured to be removed from the well and transported to another well.

13. The system of claim 1, wherein the electrical pumps each comprise a stator disposed inside the electrical pump.

14. The system of claim 1, wherein the steam pump comprises a projection disposed adjacent to the inlet, wherein the steam pump is configured to receive the fluid over a top of the projection and into the inlet.

15. The system of claim 14, wherein the steam pump comprises a gap disposed below the projection configured to relieve back pressure in the steam pump.

16. The system of claim 1, wherein the steam generator further comprises a solenoid valve configured to regulate fluid in the steam generator.

17. A method for increasing production of a well, the method comprising:

attaching an installation device to a production tree of the well, wherein the installation device comprises two upper pistons and two lower pistons;

passing a steam pump, a steam generator, and a plurality of electrical pumps into the well through the installation device such that the steam pump is disposed downhole from the steam generator, the steam generator is disposed between the steam pump and the plurality of electrical pumps, and the plurality of electrical pumps are disposed above the steam generator, wherein the steam pump, the steam generator, and the electrical pumps are connected in series via a service line cable disposed between the steam pump and the steam generator, between the steam generator and one of the electrical pumps, and between each of the electrical pumps;

determining a location of fluid in a vertical section of the well;

pumping fluid out of the vertical section of the well by sequentially powering each of the electrical pumps to pump fluid up to an adjacent electrical pump;

delivering water downhole to the steam generator through the service line cable, wherein the steam generator converts the water to steam; and rotating a turbine of the steam pump as the steam travels through a conduit of the steam pump to create a low pressure region at an inlet disposed on a downhole end of the steam pump such that fluid from the well flows through the inlet; and pumping the fluid from the well with the steam pump to the electrical pumps.

18. The method of claim 17, wherein passing the steam pump into the well comprises:

opening the two upper pistons;

passing the steam pump between the two upper pistons into a middle chamber;

closing the two upper pistons;

opening the two lower pistons;

passing the steam pump between the two lower pistons into a lower chamber, wherein the lower chamber is in fluid communication with the production tree of the well;

closing the two lower pistons;

evacuating or pressurizing the middle chamber with a pump; and feeding the service line cable between the two upper pistons through an upper bladder and the two lower pistons through a lower bladder while the two upper pistons and the two lower pistons are closed.

19. The method of claim 17, wherein passing the steam generator into the well comprises:

opening the two upper pistons;

passing the steam generator between the two upper pistons into the middle chamber;

closing the two upper pistons;

opening the two lower pistons;

passing the steam generator between the two lower pistons into the lower chamber;

closing the two lower pistons;

evacuating or pressurizing the middle chamber with a pump; and feeding the service line cable between the two upper pistons through the upper bladder and the two lower pistons through the lower bladder while the two upper pistons and the two lower pistons are closed.

20. The method of claim 17, wherein passing the electrical pumps into the well comprises:

opening the two upper pistons;

passing an electrical pump between the two upper pistons into the middle chamber;

closing the two upper pistons;

opening the two lower pistons;

passing the electrical pump between the two lower pistons into the lower chamber;

closing the two lower pistons;

evacuating or pressurizing the middle chamber with a pump; and feeding the service line cable between the two upper pistons through the upper bladder and the two lower pistons through the lower bladder while the two upper pistons and the two lower pistons are closed.

21. A downhole pump system for increasing production of a well, the system comprising:

a plurality of electrical pumps disposed in series within a vertical section of the well;

a steam generator disposed below the plurality of electrical pumps;

a steam pump disposed within a horizontal section of the well, the steam pump comprising:

a conduit for high pressure steam from the steam generator;

a turbine configured to rotate as high pressure steam travels through the conduit; and an inlet disposed on a downhole end of the steam pump, wherein the steam pump is configured to create a low pressure region at the inlet such that fluid from the well flows through the inlet, and wherein the steam pump is configured to pump the fluid to the electrical pumps; and a service line cable physically connecting the steam pump, the steam generator, and the electrical pumps, the service line cable configured to deliver water to the steam generator and steam from the steam generator to the steam pump.

22. The system of claim 21, wherein the steam pump further comprises a high pressure float valve configured to open when steam in the service line cable between the steam generator and the steam pump reaches a pre-determined pressure.

23. The system of claim 21, wherein the steam pump further comprises a projection disposed adjacent to the inlet, wherein the steam pump is configured to receive fluid over a top of the projection and into the inlet.

24. The system of claim 23, wherein the steam pump further comprises a gap disposed below the projection configured to relieve back pressure in the steam pump.

* * * * *